US009700080B1

(12) United States Patent
Hansraj et al.

(10) Patent No.: US 9,700,080 B1
(45) Date of Patent: Jul. 11, 2017

(54) MODULATING CHEST SUPPORT STRUCTURE

(71) Applicants: Kenneth K. Hansraj, Congers, NY (US); Marcia D. Griffin-Hansraj, Congers, NY (US); Jonathan A. Hansraj, Congers, NY (US)

(72) Inventors: Kenneth K. Hansraj, Congers, NY (US); Marcia D. Griffin-Hansraj, Congers, NY (US); Jonathan A. Hansraj, Congers, NY (US)

( * ) Notice: Subject to any disclaimer, the term of this patent is extended or adjusted under 35 U.S.C. 154(b) by 0 days.

(21) Appl. No.: 15/400,615

(22) Filed: Jan. 6, 2017

Related U.S. Application Data

(60) Provisional application No. 62/276,024, filed on Jan. 7, 2016.

(51) Int. Cl.
*A41C 3/00* (2006.01)
*A41F 15/00* (2006.01)

(52) U.S. Cl.
CPC ..... *A41C 3/0021* (2013.01); *A41F 15/002* (2013.01)

(58) Field of Classification Search
CPC ..... A41C 1/00; A41C 3/00; A41C 3/0028; A41C 3/0021; A41C 1/06; A41C 3/04; A41C 3/012; A41F 1/00; A41B 9/16
USPC ..... 450/59, 62, 86, 84, 85, 64
See application file for complete search history.

(56) References Cited

U.S. PATENT DOCUMENTS 2,134,294 A * 10/1938 Yerkes ..... A41C 3/00 450/59
2,388,757 A * 11/1945 Miller ..... A41C 3/00 450/84
2,454,153 A * 11/1948 Glick ..... A41C 3/00 450/36
2,475,893 A * 7/1949 Hayes ..... A41C 3/00 450/64
2,478,103 A * 8/1949 Hunau ..... A41C 3/0021 450/59
2,542,881 A * 2/1951 Ries ..... A41C 3/0078 450/59
2,638,595 A * 5/1953 Goebel ..... A41C 3/00 450/85
2,752,601 A * 7/1956 Gluckin ..... A41C 3/00 450/86

(Continued)

OTHER PUBLICATIONS

Wettenschwiler PD1, Lorenzetti S2, Stämpfli R3, Rossi RM3, Ferguson SJ2, Annaheim S3. Mechanical Predictors of Discomfort during Load Carriage. PLoS One. Nov. 3, 2015;10(11):e01.

(Continued)

*Primary Examiner* — Gloria Hale
(74) *Attorney, Agent, or Firm* — Intellectual Property Center, LLC; Arthur K. Shaffer

(57) ABSTRACT

The present invention provides a modulating chest support structure for dispersing and supporting a shifting load wherein said support structure includes a lateral torso restraint band having a pair of ends each presenting a breast interface pair each of which is spaced by a pivotal support member and a hyperbolic multi-support shoulder structure associated with each breast interface pair and including at least one interior support member, one central support member and one outer support member, each of which is spaced from said central support member along a lateral axis.

7 Claims, 12 Drawing Sheets

(56) References Cited

U.S. PATENT DOCUMENTS 2,870,768 A * 1/1959 Robinson ..... A41F 15/00 450/113
3,027,898 A * 4/1962 Williams ..... A41F 15/00 450/86
3,527,231 A * 9/1970 Catanese ..... A41C 3/10 450/60
3,623,487 A * 11/1971 Chiu ..... A41C 3/0021 2/323
3,763,865 A * 10/1973 DeFru ..... A41C 3/00 450/41
3,935,865 A * 2/1976 Newmar ..... A41C 3/0078 450/64
3,982,547 A * 9/1976 Walker ..... A41C 3/00 2/300
4,355,641 A * 10/1982 Dastoli ..... A41C 3/04 450/36
5,024,628 A * 6/1991 Sanchez ..... A41C 3/0028 2/104
6,110,007 A * 8/2000 Rittmann ..... A41C 1/10 450/1
7,513,816 B1 * 4/2009 McCullough ..... A41D 27/08 2/338
8,758,082 B1 * 6/2014 Woods ..... A41C 3/04 450/1
2008/0113587 A1 * 5/2008 Richardson ..... A41C 3/0021 450/58
2009/0126084 A1 * 5/2009 Fenske ..... A41C 3/005 2/338
2009/0270013 A1 * 10/2009 Clair ..... A41C 3/08 450/30
2011/0081827 A1 * 4/2011 Williams ..... A41C 3/0021 450/65
2012/0302135 A1 * 11/2012 Solotoff ..... A41C 3/10 450/52
2016/0037829 A1 * 2/2016 Cronin ..... A41C 3/0064 450/59

OTHER PUBLICATIONS

Phillips DB, Stickland MK, Lesser IA, Petersen SR. The effects of heavy load carriage on physiological responses to graded exercise. Eur J Appl Physiol. Feb. 2016;116(2):275-80.
Olmedo-Buenrostro BA1, Delgado-Enciso I2, Sánchez-Ramírez CA2, Cruz SA2, Vásquez C2, Mora-Brambila AB2J Sch Nurs. Jun. 2016;32(3):172-6. doi: 10.1177/1059840515606787. Epub2015.
Walicka-CupryśK1, Skalska-Izdebska R1, Rachwał M1, Truszczyńska A2.Influence of the Weight of a School Backpack on Spinal Biomed Res Int. 2015;2015:817913. doi: 10.1155/2015.
Abaraogu UO, Ugwa WO, Onwuka E, Orji E.Effect of single and double backpack strap loading on gait and perceived exertion of young adults. J Back Musculoskelet Rehabil. 2016;29.
Lee S1, Shim J2. The effects of backpack loads and spinal stabilization exercises on the dynami J PhysJ Phys Ther Sci. Jul. 2015;27(7):2257-60. doi: 10.1589/jpts.27.2257. Epub.
Sinitski EH1, Herbert-Copley AG2, Lemaire ED3, Doyle SS4, Besemann M5, Dudek NL3. Center of pressure and total force Appl Ergon. Jan. 2016;52:169-76. doi: 10.1016/j.apergo.2015.
Kim KE, Kim EJ. Incidence and risk factors for backpack palsy in young Korean soldiers. J R Army Med Corps. Feb. 2016;162(1):35-8. doi: 10.1136/jramc-2014-000403.
McCulloch R1, Sheena Y1, Simpson C1, Power D1. Brachial plexus palsy following a training run with a heavy backpack. J R Army Med Corps. Dec. 2014;160(4):317-9. doi: 10.1136/jr.
Quesada PM1, Mengelkoch LJ, Hale RC, Simon SR. Biomechanical and metabolic effects of varying backpack loading on simulated marching. Ergonomics. Mar. 2000;43(3):293-309.

* cited by examiner

MODULATING CHEST SUPPORT STRUCTURE

CROSS-REFERENCE TO RELATED APPLICATION

This application claims the benefit of the prior filed U.S. provisional application No. 62/276,024 filed Jan. 7, 2016 which is incorporated herein by reference.

FIELD OF THE INVENTION

The present invention is broadly directed to a chest support structure, and more particularly, to a non-symmetric modular chest support structure that receives, transforms, and disperses the forces of posterior and anterior loads such as breasts in a manner that reduces the forces and stresses on the spine.

BACKGROUND OF THE INVENTION

One embodiment of the current invention relates to a brassiere for supporting breasts of a woman. Breasts of young women tend to be protuberant whereas breasts of older women tend to be pendulous. Protuberant breasts are supported by fibrous tissue strands known as ligaments of Astley Cooper. When the ligaments of Astley Cooper become overstretched or atrophic, the breasts droop. The breast tissue itself does not have muscular support, the ligaments of Astley Cooper connect deep fascia at the base of the breast with overlying skin. It is the function of a brassiere to provide support for the breast tissue (acting in concert with the ligaments of Astley Cooper).

Back pain is the number one cause of disability in the United States and the world. Neck pain is number four. Global costs of back pain range between $250-$500 billion per year. Four out of five people will suffer a severe neck or back episode in their lives. There is a stronger propensity for it to be a woman.

Many women with larger breasts need support to reduce the discomfort or fatigue related to their breast size. Support is needed particularly when the woman dances or participates in physical and athletic events or the like. One approach has been merely to make thinner and smaller conventional brassieres, but this approach does provide sufficient support for some women with larger breasts.

As a result, women around the globe are suffering from spine pain, in part due to lack of support associated with their large, heavy breasts. The exact impact of the forces of the breast on the spine has just been assessed in a recent study using finite element assessments to evaluate the contribution of the size and weight of the breast to the forces seen by the spine. In a similar study finite element assessments were utilized to evaluate the forces seen in the cervical spine caused by the posture and position of the head.

As a result of the study, it was determined that women with larger breasts and increased body mass index may experience cervical, thoracic and lumbar spine pain, focused at the mid-thoracic levels (thoracic 6-8). However, force plate assessments showed significant stresses placed along the spine from the cervical 2 through lumbar 1. This pain is made worse by poor posture and the bone-weakening effects of age including menopause. Incorrectly sized bras also contribute to back spinal pain.

In addition to age, pregnancy and breast-feeding may present unique situations where the size, shape and forces of the breasts are independently and significantly fluctuating, presenting variable and modulating forces on the spine.

As women age, osteoporosis inherently weakens bone structures. This diminished bone substance leads to a decreased threshold for pain and fracture. Along with aging, especially post-menarche, women have hormonal changes that also weaken their bone structure. Osteopenia is weakening of the bone while frank bone loss is called osteoporosis. Spinal deformities such as excessive lumbar lordosis may place additional reactive forces into the thoracic spine, lowering the threshold for spine pain. Poor posture such as that caused by thoracic kyphosis contributes to inefficient weight distribution contribute to excessive pain. Scoliosis, another structural deformity, leads to inefficient and asymmetrical weight distribution on the spine from the right and left breast. To reduce pain and fatigue, balancing and diminishing breast forces to the spine becomes a critical factor.

Breast surgeries including amputation of one breast and augmentation of both breasts lead to conditions requiring separate and distinct force management of the right and left breast. Traumatic situations such as car accidents or injury on a job may lead to temporary and sometimes permanent pain generation by the spine. Balancing and diminishing breast forces to the spine may be a significant factor to reducing this pain or managing these conditions.

Structurally breasts cantilever outwardly from a wearer's chest. Conventional brassieres generally provide a panel on the wearer's back whence straps extend over the wearer's shoulders to hold up her breasts. Of course these panels tend to hold in the wearer's sides but they are situated on muscles on the back of the wearer's trunk and they tend to restrict her motion and her circulation. Right and left breasts undergo distinct and separate forces. Studies have shown that the impact of neck forces may contribute or cause back pain. Indeed neck pain; mid-back pain and lower back pain may all be caused by forces placed upon the neck, mid-back or lower back independently.

Movement of a women's chest below her breasts is quite limited compared with movement of her shoulders and movements of her back. The majority of movement below the breasts is caused by expansion and contraction of the rib cage resulting from breathing. Such movement is quite simple, being directed laterally across the chest.

The weight of the average breast weighs about 0.5 kilograms (1.1 lb.). According, it is estimated that in a typical woman, both breasts share about 8-10% of a woman's body fat. The density of fatty tissue is approximately 0.9 kg/l for all women.

If a breast cup is a hemisphere, its volume V is established by the following formula:

$$V = \frac{2\pi r^3}{3} V = \frac{\pi D^3}{12}$$

Where r is the radius of the cup, and D is its diameter.

Alternatively, if the breast cup is manipulated for a hemi-ellipsoid geometry, then the received volume may be established by the following equation:

$$V = \frac{2\pi abc}{3} V \approx \frac{\pi \times cw \times cd \times wl}{12}$$

Where a, b and c are the three semi-axes of the hemi-ellipsoid, cw=breast cup width, cd=breast cup depth, and wl=length of wire.

As is generally known, the breast cup may include many different alternative configurations, but is generally hemi-spherical or hemiellipsoidial in configuration. Generally, the underwire experiences the greatest strain and provides the greatest influence on the characteristic shape for the breast cup. It therefore, would be beneficial to provide an improved underwire design brassiere support structure for properly supporting the desired breast and its particular volume and weight.

The same underwire dimension may be utilized for a plurality of cup sizes e.g. 36A, 34B, 32C, 30D. Because the same underwire may be used for varying breast cups it needs to have flexibility in its design characteristics for containing a variety of volumetric and weight differences.

In a report by McCunn he established that the reference numbers of underwire sizes are based upon a B cup bra. As an example based on the following chart, the underwire size 32 in the US is equivalent to a 32B cup and in the UK is equivalent to 30C, and 34A. As further provided in the chart below, that means that for an underwire size of 30 width carries a cup curvature diameter of 3-inch ⅚≈=≈9.7 cm and this diameter increases by ⅓ inch≈=≈0.847 cm per increased underwire size. These estimations may be used in volume and weight calculations for consumer-sized cups which may be found in brassiere stores catering to women with large breasts. Table 1, shown below, indicates the derivation of cup volume and breast weight determined for each breast.

TABLE 1

Breast Volume and Weight Characteristics

| Under-wire Size | Bra Size - US System | Bra Size - UK System | Cup Dia-meter | Volume Of One Cup | Weight of Both Breasts |
|---|---|---|---|---|---|
| 30 | 32A 30B 28C | 32A 30B 28C | 9.7 cm (3 in 5/6) | 240 $cm^3$ (0.51 US pt) | 0.43 kg (0.95 lb) |
| 32 | 34A 32B 30C 28D | 34A 32B 30C 28D | 10.6 cm (4 in 1/6) | 310 $cm^3$ (0.66 US pt) | 0.56 kg (1.2 lb) |
| 34 | 36A 34B 32C 30D 28E | 36A 34B 32C 30D 28DD | 11.4 cm (4 in 1/2) | 390 $cm^3$ (0.82 US pt) | 0.70 kg (1.5 lb) |
| 36 | 38A 36B 34C 32D 30E 28F | 38A 36B 34C 32D 30DD 28E | 12.3 cm (4 in 5/6) | 480 $cm^3$ (1.0 US pt) | 0.86 kg (1.9 lb) |
| 38 | 40A 38B 36C 34D 32E 30F 28G | 40A 38B 36C 34D 32DD 30E 28F | 13.1 cm (5 in 1/6) | 590 $cm^3$ (1.2 US pt) | 1.1 kg (2.4 lb) |
| 40 | 42A 40B 38C 36D 34E 32F 30G 28H | 42A 40B 38C 36D 34DD 32E 30F 28FF | 14.0 cm (5 in 1/2) | 710 $cm^3$ (1.5 US pt) | 1.3 kg (2.9 lb) |
| 42 | 44A 42B 40C 38D 36E 34F 32G 30H 28I | 44A 42B 40C 38D 36DD 34E 32F 30FF 28G | 14.8 cm (5 in 5/6) | 850 $cm^3$ (1.8 US pt) | 1.5 kg (3.3 lb) |
| 44 | 44B 42C 40D 38E 36F 34G 32H 30I 28J | 44B 42C 40D 38DD 36E 34F 32FF 30G 28GG | 15.7 cm (6 in 1/6) | 1,000 $cm^3$ (2.1 US pt) | 1.8 kg (4.0 lb) |
| 46 | 44C 42D 40E 38F 36G 34H 32I 30J 28K | 44C 42D 40DD 38E 36F 34FF 32G 30GG 28H | 16.5 cm (6 in 1/2) | 1,180 $cm^3$ (2.5 US pt) | 2.1 kg (4.6 lb) |
| 48 | 44D 42E 40F 38G 36H 34I 32J 30K 28L | 44D 42DD 40E 38F 36FF 34G 32GG 30H 28HH | 17.4 cm (6 in 5/6) | 1,370 $cm^3$ (2.9 US pt) | 2.5 kg (5.5 lb) |
| 50 | 44E 42F 40G 38H 36I 34J 32K 30L 28M | 44DD 42E 40F 38FF 36G 34GG 32H 30HH 28J | 18.2 cm (7 in 1/6) | 1,580 $cm^3$ (3.3 US pt) | 2.8 kg (6.2 lb) |
| 52 | 44F 42G 40H 38I 36J 34K 32L 30M 28N | 44E 42F 40FF 38G 36GG 34H 32HH 30J 28JJ | 19.0 cm (7 in 1/2) | 1,810 $cm^3$ (3.8 US pt) | 3.3 kg (7.3 lb) |
| 54 | 44G 42H 40I 38J 36K 34L 32M 30N 28O | 44F 42FF 40G 38GG 36H 34HH 32J 30JJ 28K | 19.9 cm (7 in 5/6) | 2,060 $cm^3$ (4.4 US pt) | 3.7 kg (8.2 lb) |
| 56 | 44H 42I 40J 38K 36L 34M 32N 30O 28P | 44FF 42G 40GG 38H 36HH 34J 32JJ 30K 28KK | 20.7 cm (8 in 1/6) | 2,340 $cm^3$ (4.9 US pt) | 4.2 kg (9.3 lb) |
| 58 | 44I 42J 40K 38L 36M 34N 32O 30P | 44G 42GG 40H 38HH 36J 34JJ 32K 30KK | 21.5 cm (8 in 1/2) | 2,640 $cm^3$ (5.6 US pt) | 4.8 kg (11 lb) |
| 60 | 44J 42K 40L 38M 36N 34O 32P | 44GG 42H 40HH 38J 36JJ 34K 32KK | 22.4 cm (8 in 5/6) | 3,000 $cm^3$ (6.3 US pt) | 5.3 kg (12 lb) |

Data from a recent finite element analysis study related to the impact of forces of the breast on the spine reflected in the table below, indicates the magnitude of forces generated by each breast upon the thoracic spine ranges between 8.5 pounds of force for underwire size 30 to 110 pounds of force for underwire size 60. All increments in between were reported in Newton and pounds of force.

TABLE 2

Forces exerted upon spine by unsupported breast

| Underwire Size | Bra Size-US System | Bra Size-UK System | Weight Of Both Breasts | Stress (N/m^2) | Forces (N) | Forces (lbf) |
|---|---|---|---|---|---|---|
| 30 | 32A 30B 28C | 32A 30B 28C | 0.43 kg (0.95 lb) | 26E03 N/m^2 | 38 N | 8.54 |
| 32 | 34A 32B 30C 28D | 34A 32B 30C 28D | 0.56 kg (1.2 lb) | 35E03 N/m^2 | 48 N | 10.79 |
| 34 | 36A 34B 32C 30D 28E | 36A 34B 32C 30D 28DD | 0.70 kg (1.5 lb) | 55E03 N/m^2 | 67 N | 15.06 |
| 36 | 38A 36B 34C 32D 30E 28F | 38A 36B 34C 32D 30DD 28E | 0.86 kg (1.9 lb) | 78E03 N/m^2 | 82 N | 18.43 |
| 38 | 40A 38B 36C 34D 32E 30F 28G | 40A 38B 36C 34D 32DD 30E 28F | 1.1 kg (2.4 lb) | 95E03 N/m^2 | 102 N | 22.93 |
| 40 | 42A 40B 38C 36D 34E 32F 30G 28H | 42A 40B 38C 36D 34DD 32E 30F 28FF | 1.3 kg (2.9 lb) | 119E03 N/m^2 | 126 N | 28.32 |
| 42 | 44A 42B 40C 38D 36E 34F 32G 30H 28I | 44A 42B 40C 38D 36DD 34E 32F 30 FF 28G32F 30FF | 1.5 kg (3.3 lb) | 138E03 N/m^2 | 143 N | 32.14 |
| 44 | 44B 42C 40D 38E 36F 34G 32H 30I 28J | 44B 42C 40D 38DD 36E 34F 32FF 30G 32FF 30G 28GG | 1.8 kg (4.0 lb) | 156E03 N/m^2 | 169 N | 37.99 |
| 46 | 44C 42D 40E 38F 36G 34H 32I 30J 28K | 44C 42D 40DD 38E 36F 34FF 32G 30GG 28H | 2.1 kg (4.6 lb) | 185E03 N/m^2 | 193 N | 43.38 |
| 48 | 44D 42E 40F 38G 36H 34I 32J 30K 28L | 44D 42DD 40E 38F 36FF 34G 32GG 30H 28HH | 2.5 kg (5.5 lb) | 227E03 N/m^2 | 235 N | 52.83 |
| 50 | 44E 42F 40G 38H 36I 34J 32K 30L 28M | 44DD 42E 40F 38FF 36G 34GG 32H 30HH 28J | 2.8 kg (6.2 lb) | 256E03 N/m^2 | 262 N | 58.89 |
| 52 | 44F 42G 40H 38I 36J 34K 32L 30M 28N | 44E 42F 40FF 38G 36GG 34H 32HH 30J 28JJ | 3.3 kg (8.2 lb) | 302E03 N/m^2 | 311 N | 69.91 |
| 54 | 44G 42H 40I 38J 36K 34L 32M 30N 28O | 44F 42FF 40G 38GG 36H 34HH 32J 30JJ 28K | 3.7 kg (8.2 lb) | 338E03 N/m^2 | 342 N | 76.88 |
| 56 | 44H 42I 40J 38K 36L 34M 32N 30O 28P | 44FF 42G 40GG 38H 36HH 34J 32JJ 30K 28KK | 4.2 kg (9.3 lb) | 375E03 N/m^2 | 386 N | 86.77 |
| 58 | 44I 42J 40K 38L 36M 34N 32O 30P | 44G 42GG 40H 38HH 36J 34JJ 32K 30KK | 4.8 kg (11 lb) | 449E03 N/m^2 | 452 N | 101.61 |
| 60 | 44J 42K 40L 38M 36N 34O 32P | 44GG 42H 40HH 38J 36JJ 34K 32KK | 5.3 kg (12 lb) | 476E03 N/m^2 | 489 N | 109.93 |

The next table reflects the additional forces of the breast on the spine with a torso angularly positioned at a 20 deg. forward posture.

TABLE 3

Forces upon spine based upon poor posture

| Under-wire Size | Bra Size - US System | Bra Size - UK System | Stress (N/m^2) | Added reaction forces (N) | Added reaction forces (lbf) |
|---|---|---|---|---|---|
| 30 | 32A 30B 28C | 32A 30B 28C | 5.46E+05 N/m^2 | 53 | 11.96 (+40%) |
| 32 | 34A 32B 30C 28D | 34A 32B 30C 28D | 1.05E+05 N/m^2 | 67 | 15.11 (+40%) |
| 34 | 36A 34B 32C 30D 28E | 36A 34B 32C 30D 28DD | 1.65E+05 N/m^2 | 94 | 21.09 (+40%) |
| 36 | 38A 36B 34C 32D 30E 28F | 38A 36B 34C 32D 30DD 28E | 2.34E+05 N/m^2 | 115 | 25.81 (+40%) |
| 38 | 40A 38B 36C 34D 32E 30F 28G | 40A 38B 36C 34D 32DD 30E 28F | 2.85E+05 N/m^2 | 143 | 32.1 (+40%) |
| 40 | 42A 40B 38C 36D 34E 32F 30G 28H | 42A 40B 38C 36D 34DD 32E 30F 28FF | 3.57E+05 N/m^2 | 176 | 39.66 (+40%) |
| 42 | 44A 42B 40C 38D 36E 34F 32G 30H 28I | 44A 42B 40C 38D 36DD 34E 32F 30FF 28G | 4.14E+05 N/m^2 | 200 | 45.01 (+40%) |
| 44 | 44B 42C 40D 38E 36F 34G 32H 30I 28J | 44B 42C 40D 38DD 36E 34F 32FF 30G 28GG | 4.68E+05 N/m^2 | 237 | 53.19 (+40%) |
| 46 | 44C 42D 40E 38F 36G 34H 32I 30J 28K | 44C 42D 40DD 38E 36F 34FF 32G 30GG 28H | 5.55E+05 N/m^2 | 270 | 60.74 (+40%) |
| 48 | 44D 42E 40F 38G 36H 34I 32J 30K 28L | 44D 42DD 40E 38F 36FF 34G 32GG 30H 28HH | 6.81E+05 N/m^2 | 329 | 73.96 (+40%) |
| 50 | 44E 42F 40G 38H 36I 34J 32K 30L 28M | 44DD 42E 40F 38FF 36G 34GG 32H 30HH 28J | 7.68E+05 N/m^2 | 367 | 82.46 (+40%) |
| 52 | 44F 42G 40H 38I 36J 34K 32L 30M 28N | 44E 42F 40FF 38G 36GG 34H 32HH 30J 28JJ | 9.06E+05 N/m^2 | 435 | 97.88 (+40%) |
| 54 | 44G 42H 40I 38J 36K 34L 32M 30N 28O | 44F 42FF 40G 38GG 36H 34HH 32J 30JJ 28K | 1.01E+06 N/m^2 | 479 | 107.64 (+40%) |

TABLE 3-continued

| Forces upon spine based upon poor posture | | | | | |
|---|---|---|---|---|---|
| Under-wire Size | Bra Size - US System | Bra Size - UK System | Stress (N/m^2) | Added reaction forces (N) | Added reaction forces (lbf) |
| 56 | 44H 42I 40J 38K 36L 34M 32N 30O 28P | 44FF 42G 40GG 38H 36HH 34J 32JJ 30K 28KK | 1.13E+06 N/m^2 | 540 | 121.49 (+40%) |
| 58 | 44I 42J 40K 38L 36M 34N 32O 30P | 44G 42GG 40H 38HH 36J 34JJ 32K 30KK | 1.35E+06 N/m^2 | 633 | 142.26 (+40%) |
| 60 | 44J 42K 40L 38M 36N 34O 32P | 44GG 42H 40HH 38J 36JJ 34K 32KK | 1.43E+06 N/m^2 | 685 | 153.9 (+40%) |

Improperly fitted brassieres may be a significant factor of thoracic spine pain. The weight of the supported breasts bears mainly on the thoracic spine where horizontal and vertical force components are directed. It would therefore be beneficial to reduce the forces exerted upon the thoracic spine and to the extent possible isolate the vertical and horizontal forces from each other.

In addition, breast sizes can fluctuate depending on the body fluctuations. For example, some breasts vary in size daily, weekly, monthly and yearly based on periodic biological fluctuations due to the changes of estrogen and progesterone in a women's menstrual cycle. Pregnancy and associated breast-feeding present unique situations where the size, shape and forces of the breasts are independently and significantly fluctuating, presenting variable and modulating forces on the spine. Additionally, breast size and shapes can vary widely as the person ages, changes weight or size. Therefore, there exists a need for a modulating brassiere support structure which allows for modulation, contraction or elongation along each of the three axes.

A standard brassiere currently is not designed to handle the varying load caused by significant breast changes which may exist statically or present changes that occur over time. A standard brassiere may not be designed to handle the additional breast load and may fail based on varying breast sizes in either or both breasts. When a standard brassiere fails, it may cause additional stress and strain on the thoracic spine. It therefore, would be beneficial to provide a dynamically adjustable, properly fitted brassiere which allows for adjustment of vertical and horizontal forces through a multiple support shoulder structure to help reduce the pain.

When considering all forces generated divided by the actual weight of the breasts, the magnification factor is approximately 10×. It is interesting that the smaller underwire sizes (30 and 32) representing smaller breasts displayed a 9× (9× more force to weight). Underwire sizes 34 through 52 showed approximately a 10× force to breast weight ratio. The largest underwire sizes 54-60 demonstrated approximately 9×.

Standard brassieres do not provide proper support to avoid thoracic spine pain based on the range of forces caused by varying breast sizes. Using the American bra sizing system a woman with size 36 H would expect 52 pounds of force on the spine (for both breasts) while with weight loss she may achieve a 36D with associated 28 pounds of force for both breasts a reduction of 24 pounds upon the spine or an increased load of 24 pounds, if she gains the weight.

With an improved brassiere support structure, a reconstructive surgeon may be able to better plan breast sizing for patients based on desired thoracic spinal loads. Taking a woman from an American sized 32C (15 lbf) to an augmentation and enlargement to a 32E (23 lbf) may lead to an increase of 8 lbf. Enlarging 34B breasts (18.4 lbf) to a 34 F (32.1 lbf) result in an increase of approximately 14 lbf on the spine.

In addition to a brassiere, there are many applications where a user is required to carry a significant load for a substantial period of time, including military personnel, hikers and backpackers. Due to the weight which must be supported over an extended period, many of the same difficulties need to be addressed in other applications. For example, backpacks may carry heavy loads for significant periods while traversing a variety of terrains. In some cases, these loads are carried improperly for example at a forward angle. It would be beneficial to disperse the weight of any supported load through multiple straps each of which is adjustable and adapted for spreading the supported load over a larger portion of the torso. Many backpacks utilize a hip belt for strapping the backpack to the wearer. However, in some cases, these hip belts are improperly positioned or fail to properly support the carried load. It therefore would be beneficial to provide an improved support structure with vertically extending members between the upper body engaging member and a lower body engaging member to disperse the unidirectional tensioning load associated with the wearer's chest, dampening the moving or shifting load.

For these reasons an improved chest support structure is desired to reduce back strain and provide additional support far better than a traditional brassiere or other chest support which provides improved counter balance of the various opposing forces than in conventional chest support structures. Therefore, it would be beneficial to employ an improved support structure in these other applications like a backpack.

In general, some chest support structures utilize a shoulder strap. However, the current shoulder strap typically utilizes a singular strap which must carry the entire weight of the entire load forcing the shoulder straps into the sensitive shoulder region of the wearer causing pain and discomfort, failing to properly support the carried load and causing stress and strain upon the wearer. It therefore would be beneficial to provide an improved hyperbolic support structure with a plurality of vertical structures to reduce the weight and strain upon the back. The vertical structures may also be adjusted for improved alignment vertically and horizontally as the vertical structures are spaced from each other so that the weight of the supported load can be spread out collectively by the vertical structures to reduce the stress and strain associated with any single structure and hence upon the wearer, spreading the forces along the torso.

Based on the foregoing, there is a need for an improved chest support structure which addresses some of the aforementioned problems, including reducing the stress and strain on the thoracic spine caused by presently available, inadequate chest support structures, like brassieres and backpacks.

SUMMARY OF THE INVENTION

The present invention relates to improvements in brassieres and chest packs which dissipate the forces and stresses caused, in part, by the weight of shifting and moving loads having a variety of shapes and sizes. In particular, the present invention employs an improved exoskeleton modulating chest support structure including a hyperbolic shoulder support structure, a breast interface and an anchor support member, all adapted for reducing the forces and stresses exerted on the spine by breast weight and size. In general, with the current invention, each breast is treated as a separate entity and operates in a distinct manner to diminish its own forces. For example, the left and right breast can operate independently or collectively.

The modulating chest support structure extends longitudinally between an anterior vertical support structure and a posterior vertical support structure, originating anteriorly from the anterior plumed articulation at an anterior support junction, similarly originating posteriorly from the posterior plumed articulation at a posterior support junction. The hyperbolic support structure generally includes plural support members and as depicted includes three shoulder support members that extend longitudinally and intersect with a lateral axis, which generally extends outwardly from a torso along a shoulder. Providing plural support members allows for modulation along each of the three axes which may be required during biological changes. For example, depending on the change in the breast, it may be necessary for the shoulder support members to contract or elongate in various directions to alleviate the stress and strain of the supported breast. The three shoulder support members, depicted in FIGS. 1, 2, 3, and 5, traverse a lateral axis. The multiple support members help alleviate and disperse forces exerted on the spine.

In a general sense, a breast having a particular weight acts as a lever, which in an unsupported manner requires an equal and opposite muscular force exerted along the thoracic spine generally directed towards T6-T8. The present invention, with a low profile breast interface 20 reduces the muscular force vector by reducing the gravitational force exerted upon the breast by compressing and lifting the breast upwardly and inwardly. The present invention provides a more healthy alternative by reducing the outwardly directed force vector, allowing the thoracic spine to return to an unweighted postural condition and placing less stress along the thoracic spine. This compression and lifting also diminishes the stresses exerted along the shoulder area.

One embodiment of the current invention, in FIG. 1, provides an improved multi-support shoulder structure 10 which extends upwardly from the lateral torso restraint band 60. The orientation and structure of the shoulder support structure 10 helps reduce the negative effects of the vertical forces. The improved hyperbolic multi-support shoulder structure 10 depicted in the first embodiment generally includes multiple horizontally oriented support members, such as, the interior, central and outer support members 12, 14, 16 which extend angularly from the anterior and posterior support junctions 42, 52 and are spaced apart from each other along the lateral axis 8. In general, the interior and outer support members 12, 16 angular deflection may range from 0 to 30 degrees from the central support member 14 with the depicted angular deflection being less than 15 degrees. In FIG. 1, the central support 14 is illustrated as being generally aligned with the longitudinal axis 6 while the anterior plumed articulation 40 and posterior plumed articulation 50 are depicted as extending generally along the vertical axis 4. The hyperbolic multi-support shoulder structure 10 with the lateral torso restraint band 60 help dissipate the vertical forces exerted upon the thoracic spine (not shown). The lateral torso restraint band 60 extends from opposite sides of each breast interface 20 and generally helps redirect the non-vertical forces, namely the orthogonal and horizontal forces, inwardly along the lateral torso restraint band 60. The lateral torso restraint band 60 extends from opposite sides of the breast interface 20 along the wearer's back with an optional connectable segment 62 also referred to as a lateral torso interrupt.

The breast interface 20 extends between opposite ends of the lateral torso restraint band 60 and is frontally positioned in general alignment with the lateral axis 8 and extends between a pivotal support member 80 and the lateral torso restraint band 60. The pivotal support member 80 allows for pivoted rotation of each breast interface during operation so that the breast interface provides dynamic support for the shifting load for example during physical or energetic movement.

The breast interface 20 includes curvilinear, spherical, and bisectional support members 22, 24, 26. The curvilinear support member 22 extends laterally to present a low lower profile for receipt of a breast (not shown) and is generally adapted for placement below the breast (not shown). The spherical support member 24 extends laterally outward to outline the outward circumference of the breast (not shown) and is generally adapted for placement along the outer region of the breast (not shown). The bisectional support member 26 extends vertically between the curvilinear and spherical support members 22, 24 and is perpendicularly joined thereto. The bisectional support member 26 extends vertically along the front of the breast (not shown) from below the breast (not shown) towards the middle and is generally adapted for horizontal and vertical support of the breast (not shown). The breast interface 20 provides for improved multi-directional breast support.

A pair of the anchor support members 70 are positioned on opposite sides of breast interface 20, tangential to the curvilinear support 22 and extend therefrom to a torso restraint junction 76 on the lateral torso restraint band 60. Each anchor support member 70 is generally adapted for reinforcing the breast interface 20 and diminishing the forces exerted upon the improved exoskeleton modulating chest support structure 11.

The current invention helps transform the vertical forces generated by the outward extension of the breasts (not shown), into horizontal forces at the lateral torso restraint band 60 which allows for the forces to be dissipated therealong into the torso (not shown) by means of friction, for example.

Table 4 illustrates that in some cases, utilization of an improved brassiere support can represent as much as 70% reduction in vertical forces for a titanium wire with a 6 diameter and having an underwired size of 30. By way of example, Table 2 (above) indicates a breast sized 30D can create 15.06 pounds of force (lbf) upon the spine. According to Table 4, the current invention may reduce this force by 53.2% (or 8.01 lbf) to 7.05 lbf. Another example may include a pair of breasts sized 34D causing 22.93 lbf, according to Table 2 (above), which can be reduced by 48.4% (or 11.1 lbf) to 11.83 lbf.

Table 4 Improvement Potential with Various Embodiments of Current Invention

| Composition | Diameter | Underwire size | Weight (kg) | Improvement (%) |
|---|---|---|---|---|
| TITANIUM | 4 | 30 | 0.20527 | 52.59% |
| TITANIUM | 4 | 32 | 0.20527 | 50.93% |
| TITANIUM | 4 | 34 | 0.20527 | 43.66% |
| TITANIUM | 4 | 36 | 0.20527 | 42.37% |
| TITANIUM | 4 | 38 | 0.20527 | 42.14% |
| TITANIUM | 4 | 40 | 0.20527 | 39.56% |
| TITANIUM | 4 | 42 | 0.20527 | 39.66% |
| TITANIUM | 4 | 44 | 0.20527 | 39.65% |
| TITANIUM | 4 | 46 | 0.20527 | 40.05% |
| TITANIUM | 4 | 48 | 0.20527 | 38.74% |
| TITANIUM | 4 | 50 | 0.20527 | 38.68% |
| TITANIUM | 4 | 52 | 0.20527 | 38.10% |
| TITANIUM | 4 | 54 | 0.20527 | 38.66% |
| TITANIUM | 4 | 56 | 0.20527 | 38.70% |
| TITANIUM | 4 | 58 | 0.20527 | 37.61% |
| TITANIUM | 4 | 60 | 0.20527 | 38.27% |
| TITANIUM | 6 | 30 | 0.45682 | 69.40% |
| TITANIUM | 6 | 32 | 0.45682 | 64.24% |
| TITANIUM | 6 | 34 | 0.45682 | 53.20% |
| TITANIUM | 6 | 36 | 0.45682 | 50.16% |
| TITANIUM | 6 | 38 | 0.45682 | 48.40% |
| TITANIUM | 6 | 40 | 0.45682 | 44.63% |
| TITANIUM | 6 | 42 | 0.45682 | 44.12% |
| TITANIUM | 6 | 44 | 0.45682 | 43.43% |
| TITANIUM | 6 | 46 | 0.45682 | 43.36% |
| TITANIUM | 6 | 48 | 0.45682 | 41.46% |
| TITANIUM | 6 | 50 | 0.45682 | 41.11% |
| TITANIUM | 6 | 52 | 0.45682 | 40.15% |
| TITANIUM | 6 | 54 | 0.45682 | 40.53% |
| TITANIUM | 6 | 56 | 0.45682 | 40.36% |
| TITANIUM | 6 | 58 | 0.45682 | 39.02% |
| TITANIUM | 6 | 60 | 0.45682 | 39.58% |
| STEEL | 4 | 30 | 0.32619 | 50.93% |
| STEEL | 4 | 32 | 0.32619 | 48.29% |
| STEEL | 4 | 34 | 0.32619 | 40.74% |
| STEEL | 4 | 36 | 0.32619 | 39.03% |
| STEEL | 4 | 38 | 0.32619 | 38.30% |
| STEEL | 4 | 40 | 0.32619 | 35.67% |
| STEEL | 4 | 42 | 0.32619 | 35.55% |
| STEEL | 4 | 44 | 0.32619 | 35.30% |
| STEEL | 4 | 46 | 0.32619 | 35.48% |
| STEEL | 4 | 48 | 0.32619 | 34.15% |
| STEEL | 4 | 50 | 0.32619 | 34.00% |
| STEEL | 4 | 52 | 0.32619 | 33.37% |
| STEEL | 4 | 54 | 0.32619 | 33.79% |
| STEEL | 4 | 56 | 0.32619 | 33.75% |
| STEEL | 4 | 58 | 0.32619 | 32.73% |
| STEEL | 4 | 60 | 0.32619 | 33.26% |
| STEEL | 6 | 30 | 0.72592 | 66.52% |
| STEEL | 6 | 32 | 0.72592 | 60.10% |
| STEEL | 6 | 34 | 0.72592 | 48.79% |
| STEEL | 6 | 36 | 0.72592 | 45.23% |
| STEEL | 6 | 38 | 0.72592 | 42.82% |
| STEEL | 6 | 40 | 0.72592 | 39.02% |
| STEEL | 6 | 42 | 0.72592 | 38.22% |
| STEEL | 6 | 44 | 0.72592 | 37.22% |
| STEEL | 6 | 46 | 0.72592 | 36.86% |
| STEEL | 6 | 48 | 0.72592 | 34.94% |
| STEEL | 6 | 50 | 0.72592 | 34.49% |
| STEEL | 6 | 52 | 0.72592 | 33.47% |
| STEEL | 6 | 54 | 0.72592 | 33.65% |
| STEEL | 6 | 56 | 0.72592 | 33.37% |
| STEEL | 6 | 58 | 0.72592 | 32.14% |
| STEEL | 6 | 60 | 0.72592 | 32.52% |
| FLAT | 2 × 1 | 30 | 0.1836 | 43.49% |
| FLAT | 2 × 1 | 32 | 0.1836 | 44.52% |
| FLAT | 2 × 1 | 34 | 0.1836 | 39.68% |
| FLAT | 2 × 1 | 36 | 0.1836 | 39.70% |
| FLAT | 2 × 1 | 38 | 0.1836 | 40.68% |

-continued

| Composition | Diameter | Underwire size | Weight (kg) | Improvement (%) |
|---|---|---|---|---|
| FLAT | 2 × 1 | 40 | 0.1836 | 38.85% |
| FLAT | 2 × 1 | 42 | 0.1836 | 39.44% |
| FLAT | 2 × 1 | 44 | 0.1836 | 39.99% |
| FLAT | 2 × 1 | 46 | 0.1836 | 40.81% |
| FLAT | 2 × 1 | 48 | 0.1836 | 39.86% |
| FLAT | 2 × 1 | 50 | 0.1836 | 40.02% |
| FLAT | 2 × 1 | 52 | 0.1836 | 39.70% |
| FLAT | 2 × 1 | 54 | 0.1836 | 40.46% |
| FLAT | 2 × 1 | 56 | 0.1836 | 40.68% |
| FLAT | 2 × 1 | 58 | 0.1836 | 39.68% |
| FLAT | 2 × 1 | 60 | 0.1836 | 40.49% |

For the reasons further described below, the hyperbolic shoulder support structure 10, the breast interface 20 and the anchor support member 70, represent improvements over the prior art. Most notably, the improved exoskeleton modulating chest support structure 11 significantly reduces the forces exerted upon the spine, which in turn, reduces the pain and stresses caused by enlarged breasts. As a result, users of the present invention have experienced a reduction in pain caused by breast weight. Therefore, the improved exoskeleton brassieres support structure provides a solution not previously offered by brassieres and brassiere support structures in the prior art.

In an alternative embodiment of the current invention, use of the improved hyperbolic shoulder support structure may reduce forces that can be exerted upon the spine from a weight positioned posteriorly such as when a backpack is worn. As illustrated in Table 5, when a weight is positioned posterior, it can exert considerable forces upon the spine.

Backpacks being standard load carriers for people of all ages, especially school ages, and the military can cause of stress, strain and even disability. Global four out of five people will suffer from back and neck pain as a result of improper backpacks usage and this can lead to a cost in medical expenses and lost wages of between $250-$500 billion per year globally.

Globally, children, adolescents, adults and soldiers suffer from spinal pain, due in part to loads carried posteriorly such as those in backpacks. The impact of the forces on the spine are when the spine is in a poor posture position, such as +20 deg. forward posture, are illustrated below in Table 5 which compares the loaded weight seen in a backpack to the reaction forces exerted upon the spine in the +20 deg. position.

TABLE 5

(Below) Standard Backpack Forces in (+20 deg.) Poor Posture

| Case No. | Backpack weight (lb) | Induced Stress (N/m2) | Added Reaction force (N) | Added Reaction force (lbf) |
|---|---|---|---|---|
| 1 | 1 | 6.44E+05 | 51.733 | 11.63 |
| 2 | 2 | 1.29E+06 | 103.47 | 23.26 |
| 3 | 3 | 1.93E+06 | 155.2 | 34.89 |
| 4 | 4 | 2.58E+06 | 206.93 | 46.52 |
| 5 | 5 | 3.22E+06 | 258.67 | 58.15 |
| 6 | 6 | 3.86E+06 | 310.4 | 69.781 |
| 7 | 7 | 4.51E+06 | 362.13 | 81.411 |
| 8 | 8 | 5.15E+06 | 413.87 | 93.041 |
| 9 | 9 | 5.80E+06 | 465.6 | 104.67 |
| 10 | 10 | 6.44E+06 | 517.33 | 116.3 |
| 11 | 11 | 7.09E+06 | 569.07 | 127.93 |
| 12 | 12 | 7.73E+06 | 620.08 | 139.56 |
| 13 | 13 | 8.37E+06 | 672.53 | 151.19 |

TABLE 5-continued

| (Below) Standard Backpack Forces in (+20 deg.) Poor Posture | | | | |
|---|---|---|---|---|
| Case No. | Backpack weight (lb) | Induced Stress (N/m2) | Added Reaction force (N) | Added Reaction force (lbf) |
| 14 | 14 | 9.02E+06 | 724.27 | 162.82 |
| 15 | 15 | 9.66E+06 | 776 | 174.45 |
| 16 | 16 | 1.03E+07 | 827.73 | 186.08 |
| 17 | 17 | 1.10E+07 | 879.47 | 197.71 |
| 18 | 18 | 1.16E+07 | 931.2 | 209.34 |
| 19 | 19 | 1.22E+07 | 982.93 | 220.97 |
| 20 | 20 | 1.29E+07 | 1034.7 | 232.6 |
| 21 | 21 | 1.35E+07 | 1086.4 | 244.23 |
| 22 | 22 | 1.42E+07 | 1138.1 | 255.86 |
| 23 | 23 | 1.48E+07 | 1189.9 | 267.49 |
| 24 | 24 | 1.55E+07 | 1241.6 | 279.12 |
| 25 | 25 | 1.61E+07 | 1293.3 | 290.75 |
| 26 | 26 | 1.67E+07 | 1345.1 | 302.38 |
| 27 | 27 | 1.74E+07 | 1396.8 | 314.01 |
| 28 | 28 | 1.80E+07 | 1448.5 | 325.64 |
| 29 | 29 | 1.87E+07 | 1500.3 | 337.27 |
| 30 | 30 | 1.93E+07 | 1552 | 348.9 |
| 31 | 31 | 2.00E+07 | 1603.7 | 360.53 |
| 32 | 32 | 2.06E+07 | 1655.5 | 372.16 |
| 33 | 33 | 2.13E+07 | 1707.2 | 383.79 |
| 34 | 34 | 2.19E+07 | 1758.9 | 395.42 |
| 35 | 35 | 2.25E+07 | 1810.7 | 407.05 |
| 36 | 36 | 2.32E+07 | 1862.4 | 418.68 |
| 37 | 37 | 2.38E+07 | 1914.1 | 430.31 |
| 38 | 38 | 2.45E+07 | 1965.9 | 441.94 |
| 39 | 39 | 2.51E+07 | 2017.6 | 453.57 |
| 40 | 40 | 2.58E+07 | 2069.3 | 465.2 |
| 41 | 22.67 | 3.22E+07 | 2586.6 | 581.5 |
| 42 | 34.01 | 4.77E+07 | 3828.2 | 860.62 |
| 43 | 45.35 | 6.44E+07 | 5173.5 | 1163 |

Simulating the forces exerted upon the spine with a backpack utilizing only one strap increased the force magnification by 7.25× uniformly for the sampled load weights of from one to forty, fifty, seventy-five and one hundred pounds. Using a backpack with both straps illustrated that the force magnification was uniformly 7.23.

Improper posture or angular deflection can dramatically increase the stress and strain exerted upon the spine. As illustrated in Table 6, a forward angular posture of twenty degrees (+20) from a neutral position (+0 deg.) can increase the force 4.4 times.

TABLE 6

| showing the impact of poor posture with a posterior load. | | | | |
|---|---|---|---|---|
| Weight | Force (+0) deg. (lbf.) | Force in +20 Degrees (lbf.) | Difference (%) | Difference (lbf.) |
| 1 lb | 7.2 (7.2X) | 11.6 (11.6X) | 4.4X (+62%) | 4.4 |
| 25 lb | 180 (7.2X) | 290.8 (11.6X) | 4.4X (+62%) | 110.8 |
| 50 lb | 360 (7.2X) | 581.5 (11.6X) | 4.4X (+62%) | 221.5 |
| 75 lb | 540 (7.2X) | 860.6 (11.6X) | 4.4X (+62%) | 320.6 |
| 100 lb | 720 (7.2X) | 1163 (11.6X) | 4.4X (+62%) | 443 |

As illustrated in Table 6, a backpack utilizing an improved exoskeleton brassiere support structure including a hyperbolic shoulder support structure which can help bias the shoulders and improve posture can dramatically reduce the forces and stresses exerted on the spine by the posterior load of the backpack.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

Figure 1:
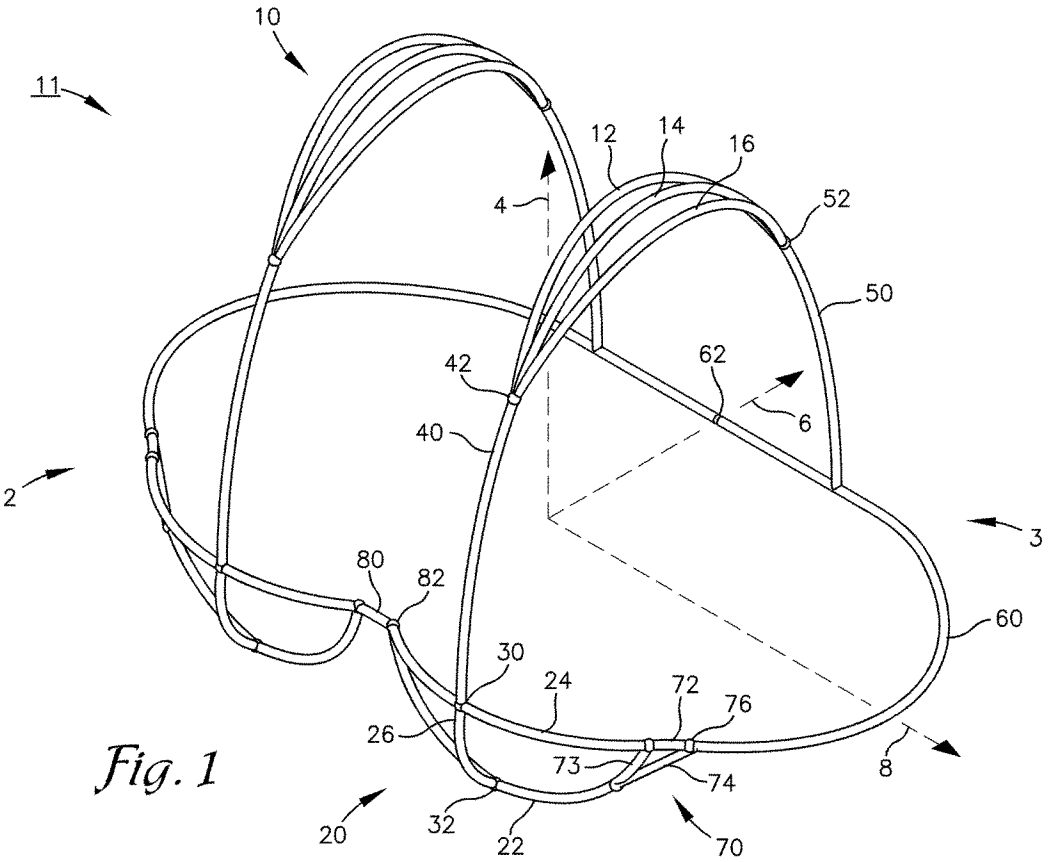
FIG. 1 is a front perspective view of the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 11 (FIGS. 1-6) generally designates one embodiment of an improved exoskeleton brassiere support structure adapted for supporting weight of received breast (not shown) and dispersing the weight using a new and improved structure in a new and improved way to reduce the stresses and strain exerted upon a spinal column. Reference numeral 10 (FIGS. 1-3 and 5) generally designates an improved hyperbolic multi-support structure 10. Reference numeral 20 (FIGS. 1, 2, 4, and 5) generally designates an improved breast interface 20. Reference numeral 70 (FIGS. 1, 2, and 4) generally designates an improved anchor support member.

Figure 4:
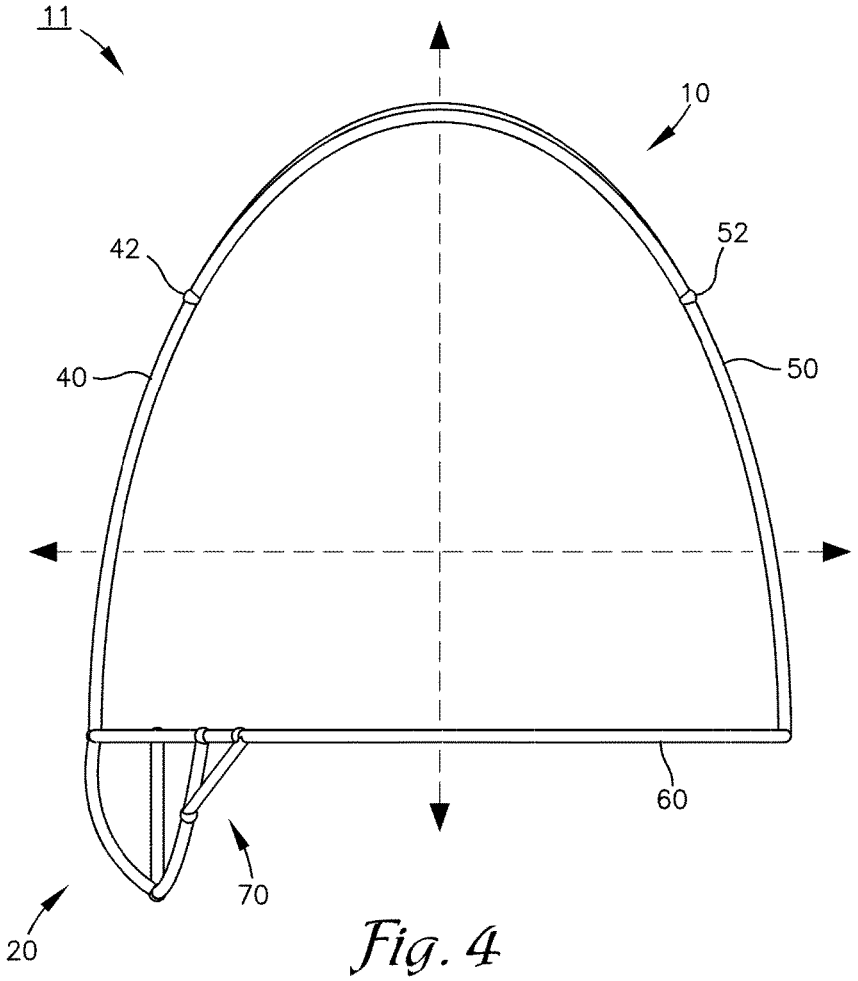
FIG. 4 is a right side elevation view of the present invention.
Figure 5:
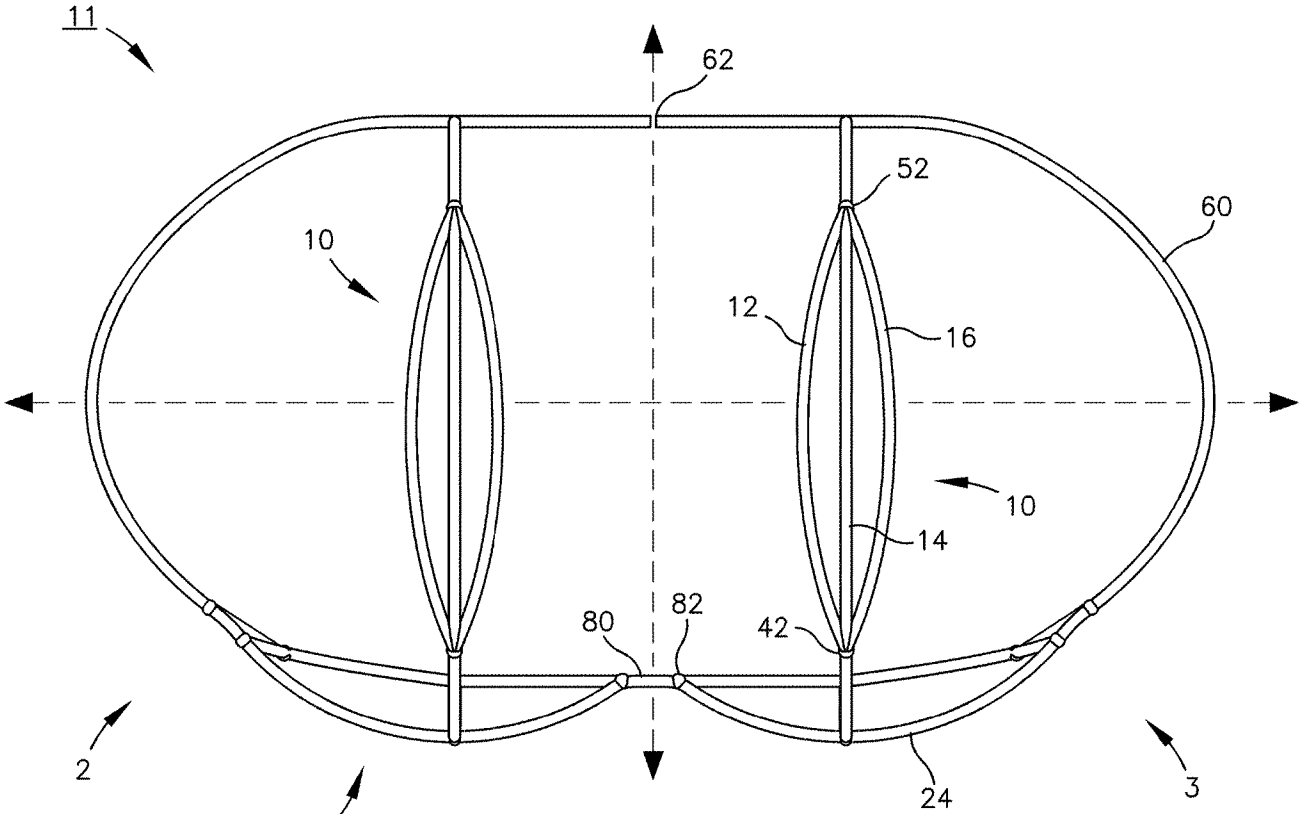
FIG. 5 is top plan view of the present invention.

Referring to FIG. 1, the illustrated improved exoskeleton brassiere support structure 11 includes a vertical, longitudinal, and lateral axis 4, 6, 8. Referring to FIGS. 4 and 5, the improved exoskeleton brassiere support structure 11 is symmetrical along the plane of the vertical and longitudinal axes 4, 6. For purpose of efficiency, in some cases one side of the improved brassiere support structure 11 is described, where it is understood that the described support structure is mirrored along the vertical axes 4 and the same description would apply to the left and right sides 2, 3 of the present invention 11.

Referring to FIGS. 1, 4, and 5, each of the right and left side 2, 3 of the illustrated embodiment of the improved exoskeleton brassiere support structure 11 include the hyperbolic multi-support shoulder structure 10, breast interface 20, anchor support member 70, anterior and posterior plumed articulations 40, 50 and a lateral torso restraint band 60. The right side 2 and the left side 3 are anteriorly joined by a pivotal support member 80 extended between each breast interface 20.

The pivotal support member 80 extends between a pair of inner articulating joints 82, each associated with one of the breast interface 20, the pivotal support member 80 being substantially rigid there between. In the illustrated embodiment, each inner articulating joint 82 includes a rotational structure like a ball and socket for independent rotation of the pivotal support member 80 in relation to the spherical support member 24 and the curvilinear support member 22.

During use, the pivotal support member 80 is generally positioned anteriorly over the sternum, the lateral torso restraint band 60 extending laterally from each outer articulating joint 72 towards the lateral torso interrupt 62. In an embodiment of the invention, a releasable clasp or fastener (not shown) may be employed in association with the lateral torso interrupt 62 pair. Alternatively, the clasp (not shown) may be positioned laterally, posteriorly or anteriorly for connecting the lateral torso restraint band 60. In this way, the clasp (not shown) may provide for tightening or loosening the lateral torso restraint band 60 as desired.

Referring to the embodiment illustrated in FIGS. 1, 2, 4, and 5, the breast interface support 20 is generally positioned for supported receipt of a breast (not shown) and includes a curvilinear support member 22 and a spherical support member 24. Generally, the breast interface support 20 presents a convex low-profile elliptical breast support structure adapted for supporting a breast (not shown). The convex low-profile breast support provides sufficient support for a variety of breast sizes by supporting the breast (not shown) from underneath, while positioning the breast with a the desired lower pole to upper pole ratio while the nipples are pointed ever so slightly upward. In one embodiment, the one breast orientation of the supported female breast (not shown), using the nipple as a dividing line, is 45:55 upper pole to lower pole ratio. This means that 45 percent of the breast is located above the nipple and 55 percent being positioned below the nipple. In relation to the breast interface 20, the supported breast orientation in one embodiment may result in a low profile elliptical support structure being adapted for receiving 55 percent of the breast between the curvilinear support member 22 and the spherical support member 24, with the other 45 percent being located above the spherical support member 24.

The curvilinear support member 22 extends circumferentially between inner and outer articulating joints 82, 72 forming a lower elliptical surface for placement below the breast providing at least partial vertical support to the breast. The spherical support member 24 extends outwardly circumferentially forming an outer parabolic surface for placement on the outer breast surface (not shown) providing at least partial horizontal and vertical support of the breast. The curvilinear and spherical support members 22, 24 generally present an elliptical shape to the breast interface support 20. The breast interface support extends generally between two articulating joints, the inner articulating joint 82 being medially positioned and an outer articulating joint 72 being laterally located. Each of the breast interface supports 20 is generally secured between the lateral torso restraint band 60 and the pivotal support member 80. In the embodiment depicted in FIG. 2, the curvilinear and spherical support members 22, 24 are generally secured to the lateral torso restraint band 60 and anchor torso joint 74.

The embodiment depicted in FIGS. 1-5 includes a bisectional support member 26 that extends circumferentially between the curvilinear and spherical support members 22, 24. The bisectional support member 26 is joined to the curvilinear support member 22 at a lower unifying junction 32 and to the spherical support member 24 at the upper unifying junction 30. The bisectional support member 26 bisects the curvilinear support member 22 and the spherical support member 24 to allow for lateral and horizontal rotation about each corresponding lower and upper unifying junction 32, 30. In the depicted embodiment, the bisectional support member 26 extends circumferentially upwardly along the elliptically configured breast interface support 20 presenting a contoured surface for supporting the received breast (not shown) while reducing the exerted strain upon the thoracic spinal column. In one embodiment, the bisectional support member 26 may be fabricated from a substantially rigid material like a coil or wire.

The breast interface 20 depicted in FIG. 1-6 has a generally elliptical low-profile and is biased for supporting the breast with an upward and inward support vector (not shown). As depicted in the embodiment shown in FIGS. 1-5, each breast interface 20 includes curvilinear, spherical, and bisectional support members 22, 24, 26, the spherical support member 24 extending substantially from the lateral torso restraint band 60 to the pivotal support member 80. The curvilinear support member 22 extends angularly from the lateral torso restraint band 60 at anchor support 70 and returns at the inner articulating joint 82. The bisectional support member 26 extends from the lower unifying junction 32, between the curvilinear support member 22 and the spherical support member 24, and terminating at the upper unifying junction 30. Each of the breast interface support members 22, 24, 26 may be fabricated from a substantially rigid material having a cylindrical shape like aluminum, steal or titanium wire adapted for receiving multi-dimensional forces during rotational movement of the supported weight to disperse those forces as desired along the breast interface 20, the lateral torso restraint band 60, the hyperbolic multi-support shoulder structure 10 of the exoskeleton modulating chest support structure 11.

Figure 2:
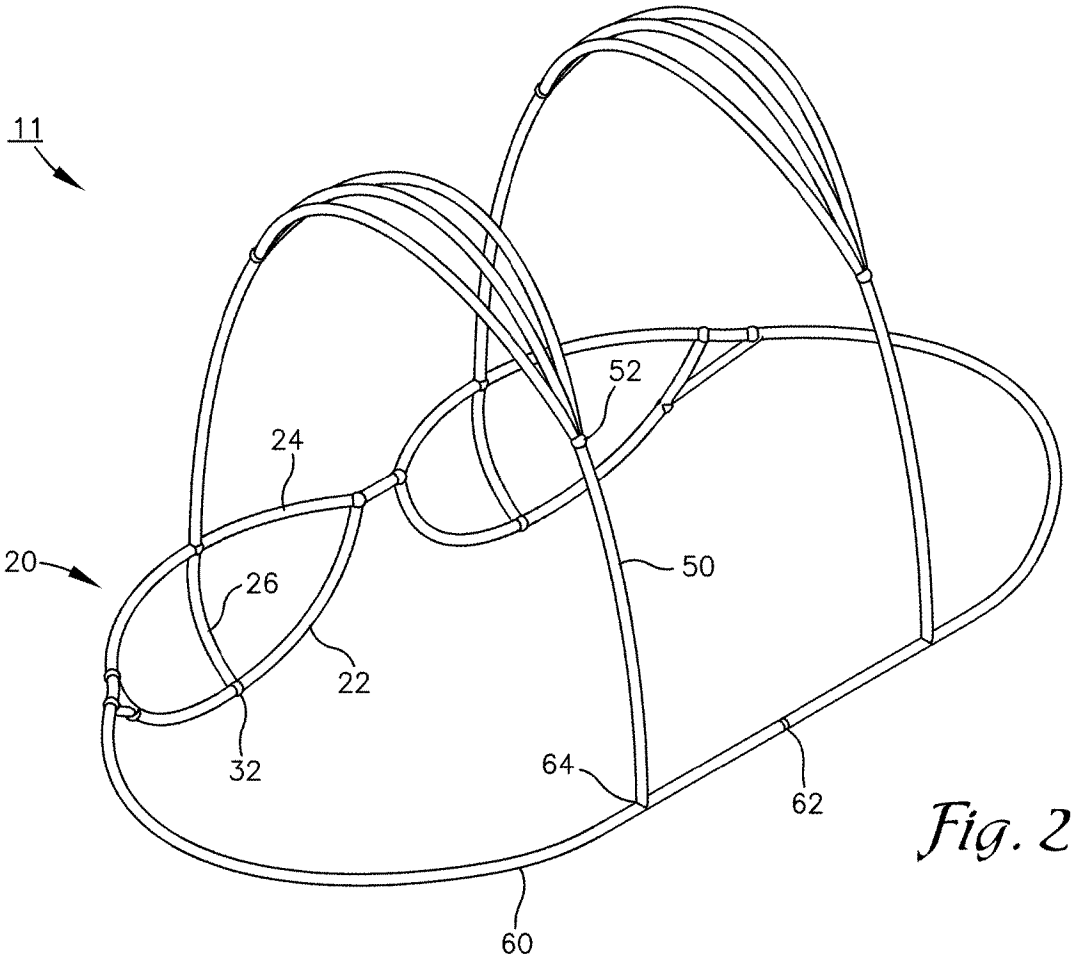
FIG. 2 is a rear perspective view of the present invention.
Figure 3:
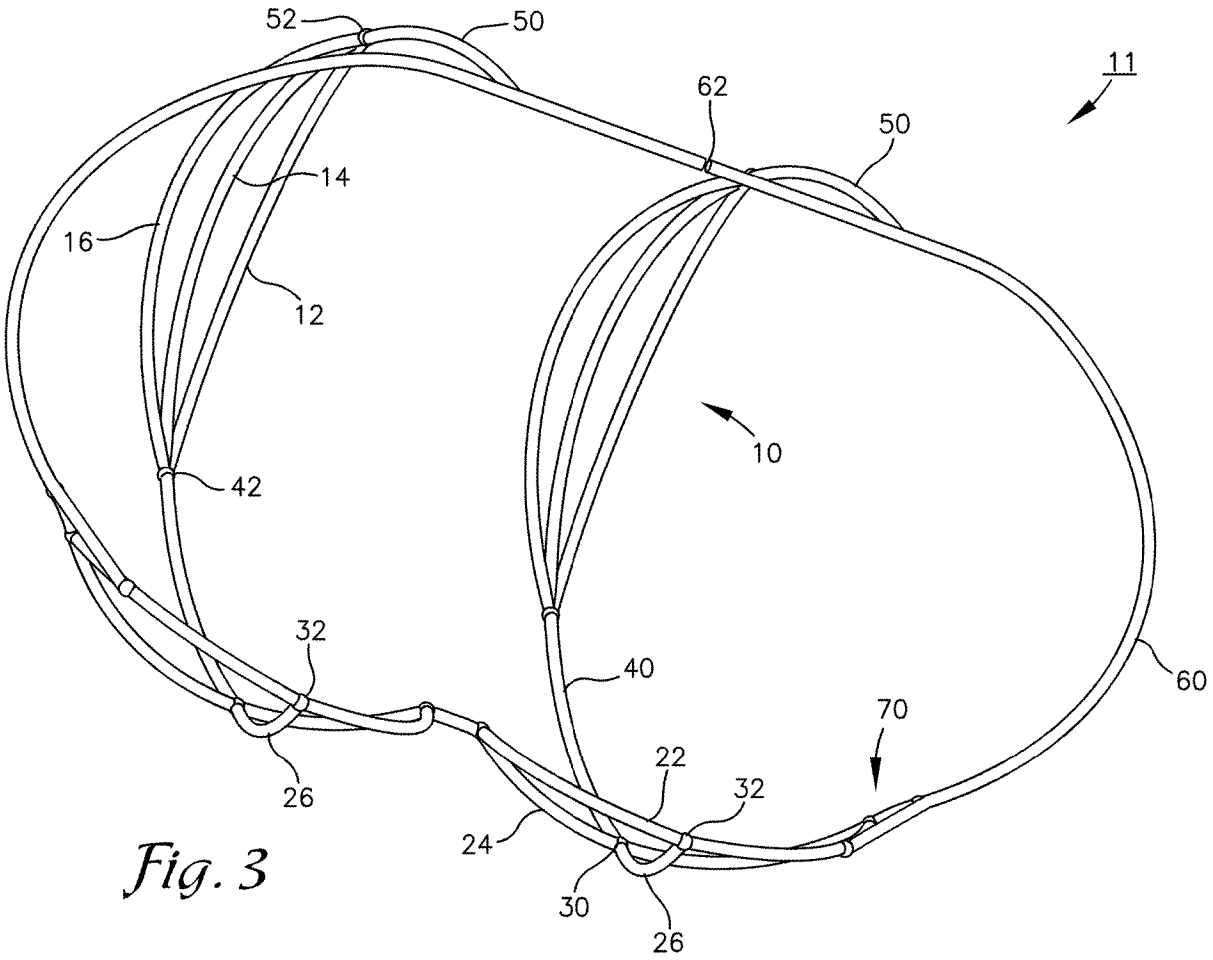
FIG. 3 is a bottom perspective view of the present invention.

Referring to FIGS. 1, 2, and 4, the anchor support member 70 is angularly positioned between the breast interface 20 and the lateral torso restraint band 60. As depicted in the embodiment illustrated in FIGS. 1-5, the anchor support member 70 extends tangentially to the curvilinear support member 22 at the outer articulating joint 72 towards an anchor torso junction 74. Generally the anchor support member 70 extends toward the anchor torso junction 74 associated with the lateral torso restraint band 60. The anchor support member 70 generally secures the breast interface support 20 to the lateral torso restraint band 60 while providing for receipt and transmission of the supported weight between the breast interface 20, the hyperbolic multi-support member and the lateral torso restraint band 60, thereby distributing the weight of the supported breast along the lateral torso restraint band 60. The anchor support member 70 provides additional distribution along redundant paths to the lateral torso restraint band 60 for distributing the horizontal, vertical and oblique components of the supported weight. In one embodiment the outer articulating joint 72, the anchor torso joint 74 and the lateral torso joint 73 operate cooperatively with the pivotal support member 80 to allow for desired rotation of the breast interface 20 during receipt of the breast (not shown) to selectively support and distribute weight. The anchor support members 70 are generally adapted for receiving and supporting the breasts during operation of the exoskeleton modulating chest support structure 11.

Generally in operation, the lateral torso restraint band 60 extends circumferentially around a torso between a pair of posterior lateral torso interrupts 62. As depicted in FIG. 1, the lateral torso restraint band 60 begins at a first lateral torso interrupt 62, extending from a posterior region associated with the perpendicular junction 64 extending outwardly and circumferentially along the right side 2 towards the frontal region associated with the pair of breast interface supports 20 to the anchor support member 70. The second end of the lateral torso restraint band 60 extends from a second lateral torso interrupt 62 on the posterior region through a second perpendicular junction 64, extending outwardly along the left side 3 towards the frontal region associated with the breast interface supports 20. The pair of breast interface 20, separated by the pivotal support member 80 are each joined laterally to the lateral torso restraint band 60 along the left (3) and right (2) sides. Each side of the lateral restraint member 60 is secured to the anchor support member 70 at the torso restraint junction 76. The lateral torso restraint band 60 being substantially rigid and fabricated from cylindrically shaped material such as wire from a secure and substantially rigid torso connection. The lateral torso restraint band 60 providing vertical, horizontal and oblique support for the exoskeleton brassiere support structure 11.

Referring to FIGS. 1, 4 and 5, the hyperbolic multi-support shoulder structure 10 extends longitudinally between the interior support junction 42 and a posterior support junction 52. The hyperbolic multi-support structure 10 is curved with a vertical and horizontal vector component about the lateral axis 8 which is generally adapted for use as a shoulder strap having a contoured surface adapted for receipt by the shoulder or trapezius muscle (not shown) and during use, rests upon the shoulder or trapezius muscle.

The hyperbolic multi-support structure 10 generally includes plural support members for disbursing the supported weight and is adapted for placement along the clavicle. As depicted in the FIGS. 1, 2, and 5 the hyperbolic multi-support structure 10 may include an interior support member 12, a central support member 14, and an outer support member 16. The interior support member 12 is generally positioned medially, nearer to the vertical axis 4, the outer support member 16 being positioned laterally, outwardly from the vertical axis, and the central support member 14 is generally centrally positioned between the interior and outer support members 12, 16.

The inner, central and outer support members 12, 14, 16 angularly extend from the anterior support junction 42 and terminate at the posterior support junction 52. The inner, central, and outer support members 12, 14, 16 traverse the lateral axis 8 after separately traversing the vertical axis 4 the inner, central and outer support members 12, 14, 16 rejoin at the posterior support junction 52.

In one embodiment, the inner, central, and outer support members 12, 14, 16 are substantially rigid wire members, braided or unbraided and adapted for spaced apart placement along the lateral axis 8, as they are positioned for use. Generally, during use the wearer will wear the inner, central and outer support member 12, 14, and 16 along the region between the shoulder and neck (not shown).

In an embodiment, the inner and outer support members 12 and 14 are angularly spaced from the central support member 14 by approximately 15 degrees with the separation distance corresponding to the angular separation and having a maximum separation distance roughly, midway between the anterior and posterior support junctions 42, 52.

During use, the hyperbolic multi-support structure 10 generally rests upon the shoulder or trapezius muscle (not shown) with the inner shoulder support member 12 adapted for receipt along the interior, the outer shoulder support member 16 spaced outwardly therefrom, and the central shoulder support member 14 positioned between the inner and outer shoulder support members 12, 16. In general, the inner, central, and outer support members 12, 14, 16 are spaced to allow for distributing the supported weight along the lateral axis 8 at plural locations on the shoulder or trapezius muscle.

Referring to FIG. 1, the anterior support junction 42 joins an anterior plumed articulation also referred to as an anterior vertical support member 40 to the hyperbolic multi-support structure 10. The anterior vertical support member 40 generally extends from the breast interface 20, towards the hyperbolic multi-support 10. An upper unifying support 30 generally joins the breast interface 20 to the lateral torso restraint band 60. In one embodiment the anterior plumed articulation 40 is substantially rigid and has a braided or unbranded wire structure although other support structures may be utilized. Generally, the anterior plumed articulation 40 receives and disperses the supported weight along the lateral torso restraint band 60 and the hyperbolic multi-support structure 10.

Referring to FIG. 2, the posterior support junction 52 joins the posterior plumed articulation 50 to the hyperbolic multi-support structure 10. Generally the posterior plumed articulation 50 extends upwardly to the hyperbolic multi-support structure 10 from the lateral torso restraint band 60. The posterior plumed articulation 50 is generally secured to the lateral torso restraint band 60 at a perpendicular junction 64. Alternatively, each of the posterior plumed articulations 50 may extend crosswise in a cross-body fashion to opposite sides of the lateral torso restraint band 60 to provide both vertical and lateral support for the supported load (not shown).

As depicted, the posterior plumed articulation 50 of FIG. 2 is substantially rigid and in the depicted embodiment may be comprised of a braided or unbraided cylindrical wire. The lateral torso restraint band 60 generally receives the projected forces extended by both posterior plumed articulations 50, both posterior plumed articulations 40 and both breast interfaces 20.

In the embodiment of the invention depicted in FIGS. 1-5, the breast interface 20 and the anterior plumed articulation 40 are adapted for horizontal bias of the supported weight, for example, towards the torso. The spherical support member 24, the bisectional support member 26, and the anterior vertical support member 40 join at the upper unifying junction 30, are biased such that when compressed provide an inwardly facing compression force. In this manner, the exoskeleton modulating chest support structure 11 reduces the outwardly facing force exerted upon the torso, thereby reducing stress and strain.

Additionally, the hyperbolic multi-support shoulder structure 10 in conjunction with the posterior plumed articulation 50 provide a combined vertical and horizontal bias of the supported weight, for example upwardly and inwardly, towards the upper torso such that when the breast interface 20 is under a load, the hyperbolic multi-support shoulder structure disperses the weight across multiple spaced apart support members (interior, central and outer support members) 12, 14, 16. The interior, central and outer support members 12, 14, 16 are offset from each other and are adapted to reduce the transferred load. In the depicted embodiment, the interior, central and outer support members 12, 14, 16 define a flexible hyperbolic paraboloid where each are adapted for frictional engagement along the wearer's torso, for example, a shoulder for receiving the reduced load.

Each of the perpendicular junction 64 as depicted in FIG. 2 joins the posterior plumed articulation 50 to the lateral torso restraint band 60 and provides tension upon the anterior support junction 42, biasing the breast interface 20 vertically and horizontally, for example, inwardly and upwardly. The illustrated posterior junctions 64 combing and secure the outer, central and interior support members 216, 214, 212 to the posterior plumed articulation 50 while allowing for independent angular deflection along the horizontal and the vertical axes for distributing the vertical and horizontal load vectors along the lateral torso restraint band 60 while providing necessary support and without exerting undue stress or strain upon the spine.

Figure 11:
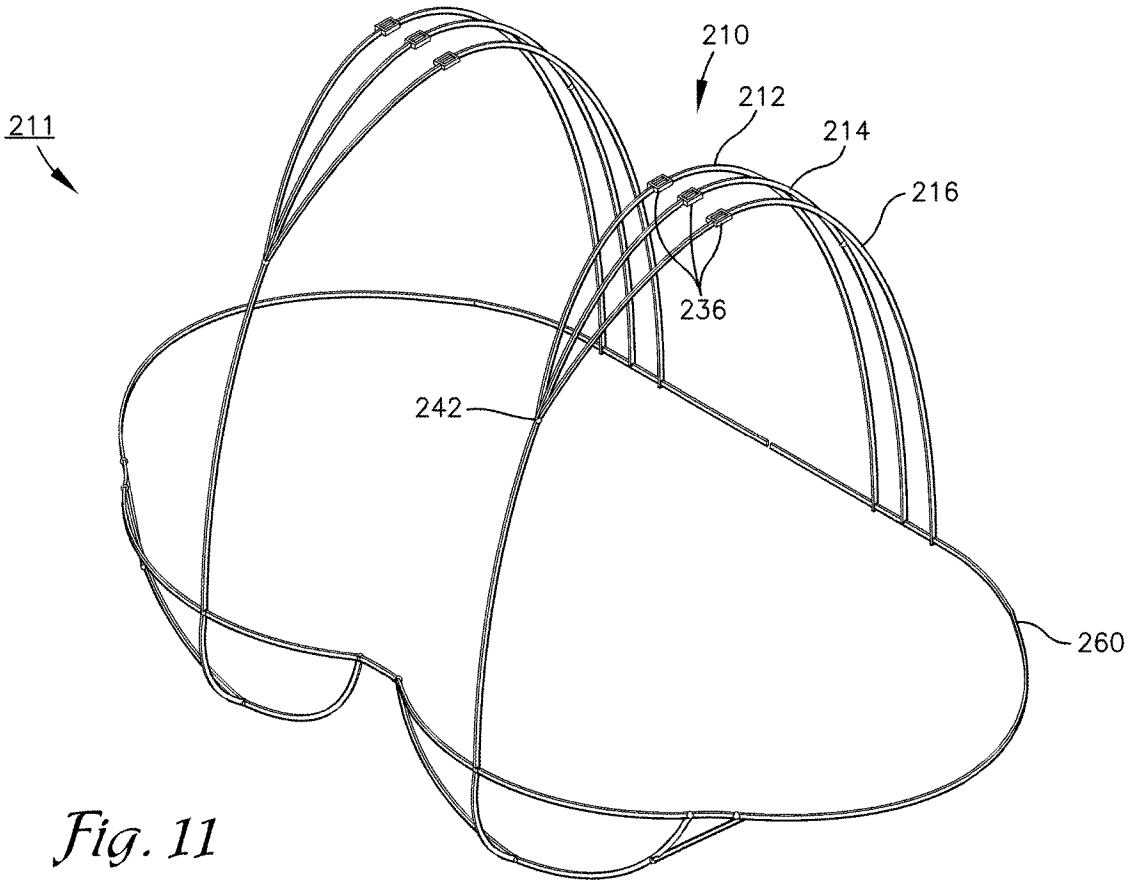
FIG. 11 is a left side perspective of an alternative embodiment of the improved exoskeleton brassiere support structure.
Figure 12:
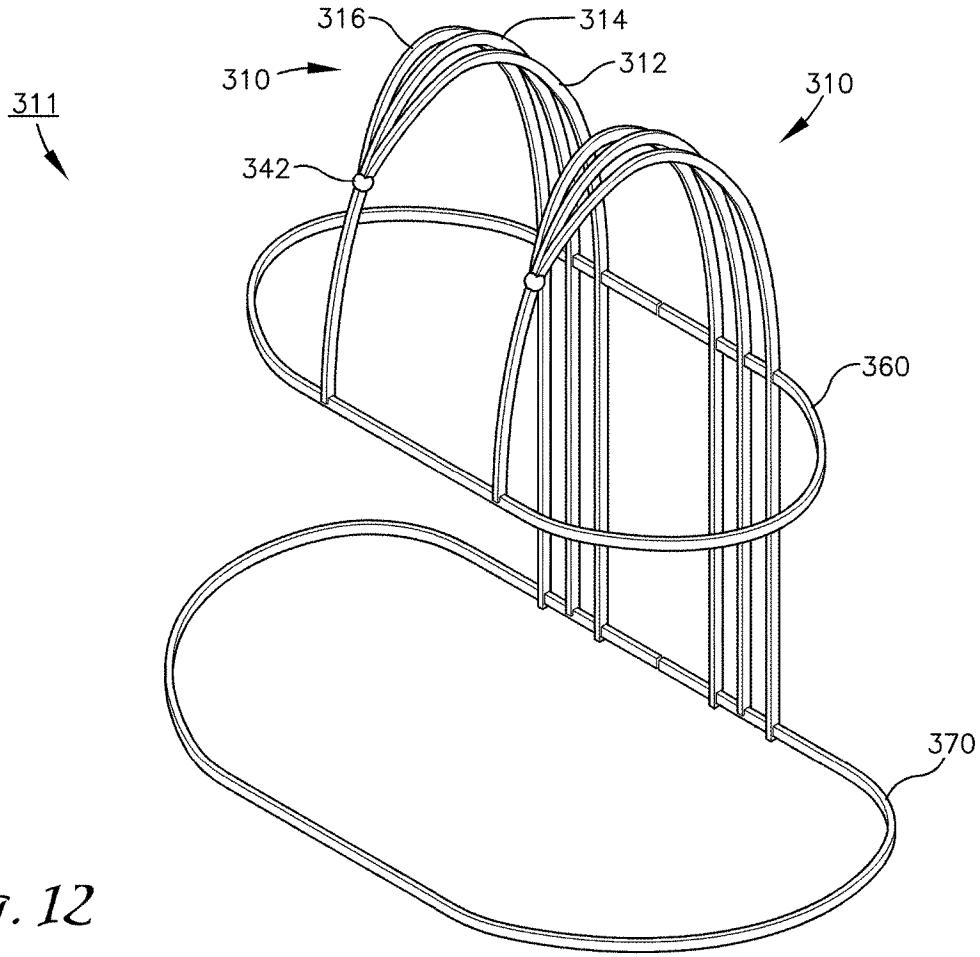
FIG. 12 is a left side perspective of an alternative embodiment of the lower torso restraint band.

As depicted in the alternative embodiments of FIGS. 11 and 12, a posterior support junction may be omitted from the present invention and three posterior plumed articulations may extend from each support member to the lateral torso restraint band 60 as desired.

In this manner the compressible upper unifying junction 30 and associated bisectional rigid support member 26 react to the received breast by placing inward pressure against the breast, causing the receiving breast to press upwardly and inwardly in a manner which causes the received breast to lift upwardly for display as desired.

While the bisectional support member 26, anterior vertical support member 40, posterior plumed articulation 50 and lateral torso restraint band 60 are depicted as being substantially rigid, they may vary in length as desired. Generally, they can be varied to allow for varying load efficiencies with the modular reduction from the hyperbolic multi-support structure 10 being reduced approximately 50%, the lateral torso restraint band 60 contributing to a modular reduction of approximately 40% and the breast interface 20 contributing to a reduction of approximately 10%.

In an embodiment of the invention, the exoskeleton modulating chest support structure 11 receives and disperses vertical and horizontal forces from breast size and weight. The breast interface 20 receiving vertical and horizontal forces from breast weight and size and being adapted for compression of the breast, forcing the breast towards the user's body, thereby dispersing horizontal forces and reducing vertical forces received by the hyperbolic multi-support structure 10.

One optional aspect of the present invention utilizes a flexible, articulating joint where the anterior support junction 42 and the upper unifying support junction 30 are capable of articulation either jointly or individually. By way of example, in the depicted embodiment articulation at the upper unifying support junction 30 may be accomplished by receiving a tapered end (not shown) at the spherical support member 24 by a collared end (not shown) of the upper unifying support junction 30. The tapered end-collared end engagement allowing for secured independent rotation of the spherical support member 24 at the upper unifying support junction 30. The articulation of the anterior support junction 42 and the upper unifying support junction 30, may allow for self-alignment of the exoskeleton modulating chest support structure 11 during receipt and targeted distribution of the supported weight to reduce stress and strain upon the spine.

Referring to FIGS. 6-10, a second embodiment is illustrated of an improved exoskeleton support structure 111 with an alternative lateral torso support band including an upper torso restraint band and lower torso restraint band 160, 170 in communication with a hyperbolic multi-support shoulder structure 110 having multiple support members 110*a*, 110*b*, 110*c* extending from a posterior position on the upper support band 160 towards a dorsal position. A pair of vertical supports 166 may be provided between the upper and lower torso restraint bands 160, 170 for aligned communication between and the upper torso restraint band 160 and the lower torso restraint band 170. The vertical support pair 166 may alternatively be located on the dorsal, frontal or lateral position. The upper and lower torso restraint bands 160, 170 may optionally include a number of releasable generally known fasteners or clasps (not shown).

Figure 6:
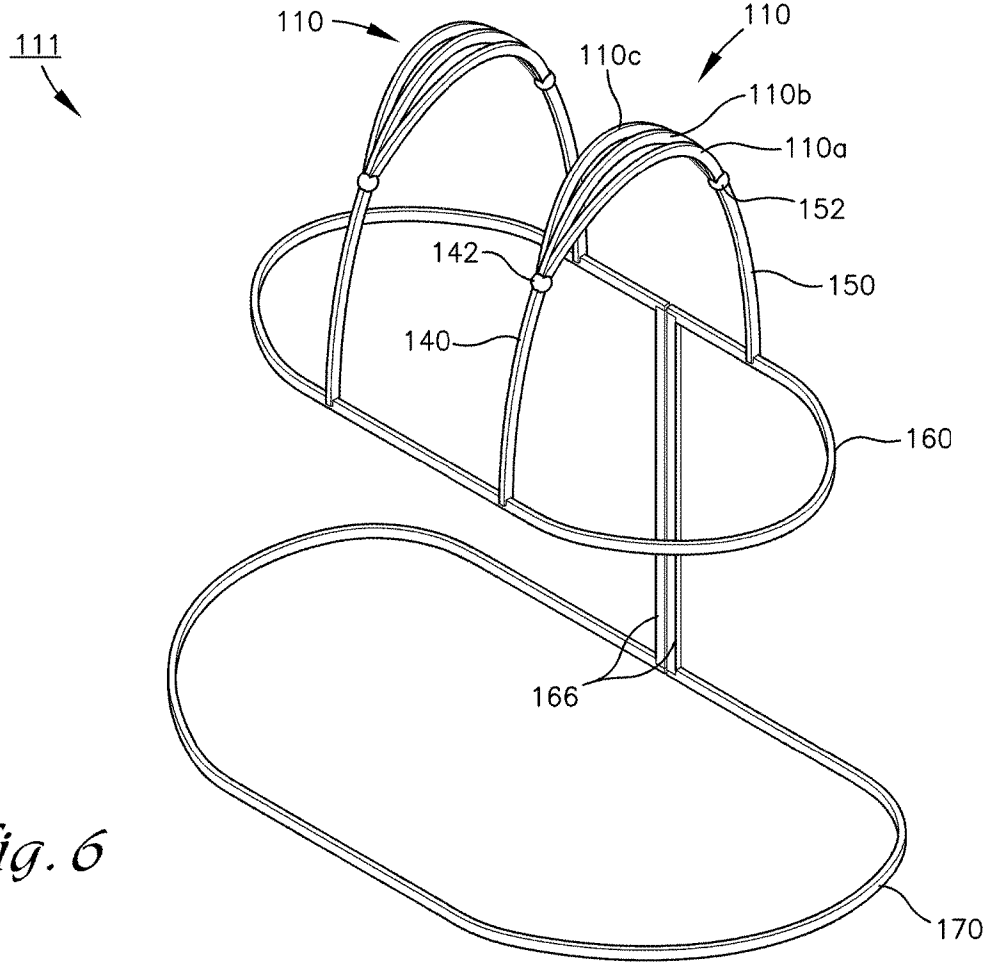
FIG. 6 is a front perspective view of the present invention.

Although the connecting members illustrated in FIGS. 6-10 have a pair of oppositely facing substantially planar surfaces, the embodiment is not limited thereto and may utilize other known configurations. Additionally, FIG. 6 illustrates the pair of vertical supports 166 each having a pair of oppositely facing, substantially planar surfaces with the substantially planar surface 166*a* extendable along an adjacent torso (not shown). Each of the vertical supports 166 presents an interconnected junction with each of the upper and lower torso restraint bands 160, 170 for providing a substantially planar adjacent surface.

Figure 7:
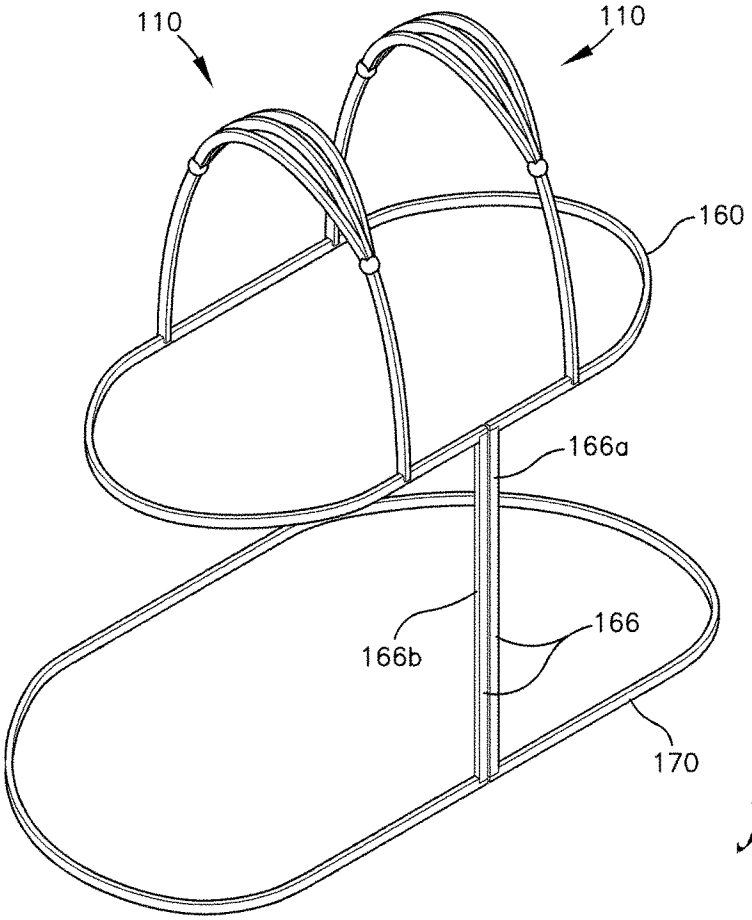
FIG. 7 is a front perspective view of a second embodiment of the present invention illustrated with a lower torso restraint band.
Figure 10:
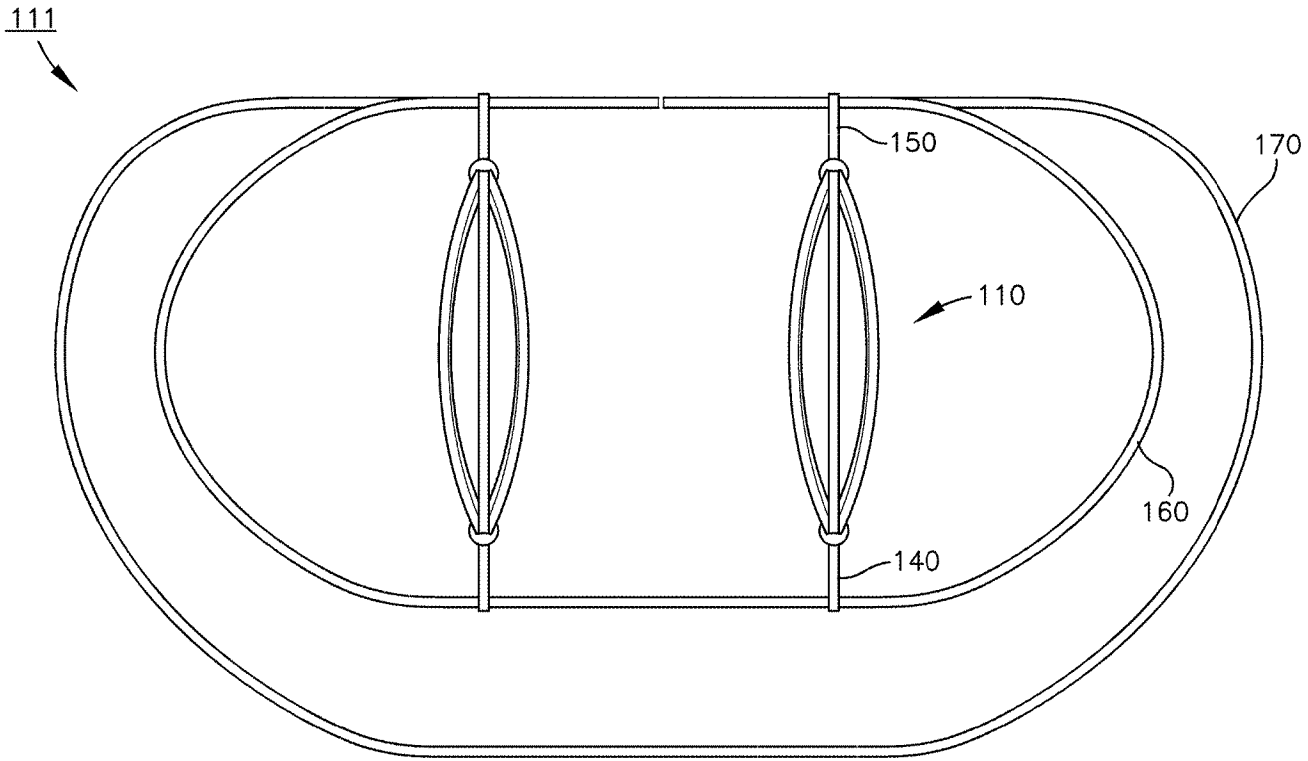
FIG. 10 is a top plan view of the embodiment of FIG. 7.

FIGS. 7 and 10 illustrate an anterior plumed articulation 140 extending upwardly between the upper torso restraint band 160 and an anterior support junction 142 which is illustrated as being generally spherical, although other configurations may be utilized. Each of the hyperbolic multi-support shoulder structures 110 extends between and is in communication with the anterior and posterior plumed articulation 140, 150 at the anterior and posterior support junctions 142, 152.

Figure 8:
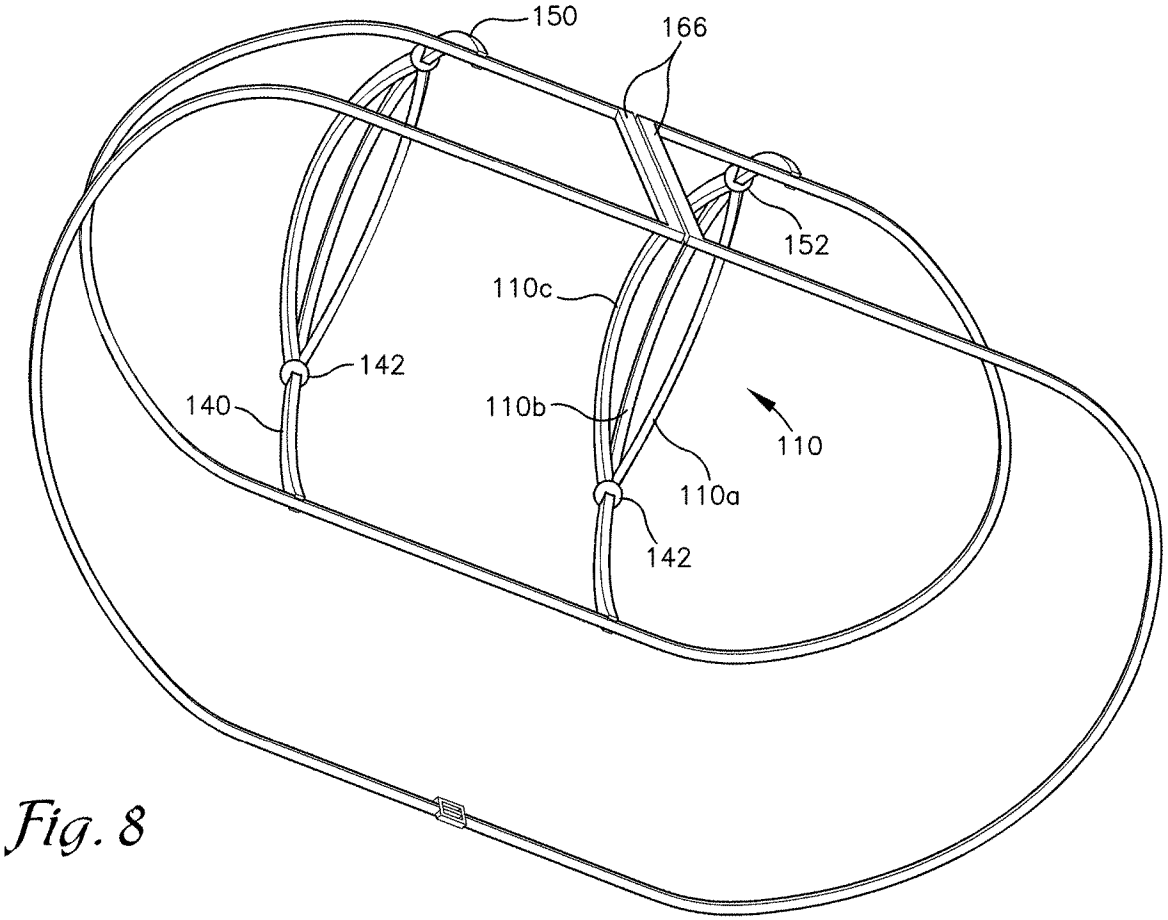
FIG. 8 is a bottom perspective view of the second embodiment of FIG. 7.
Figure 9:
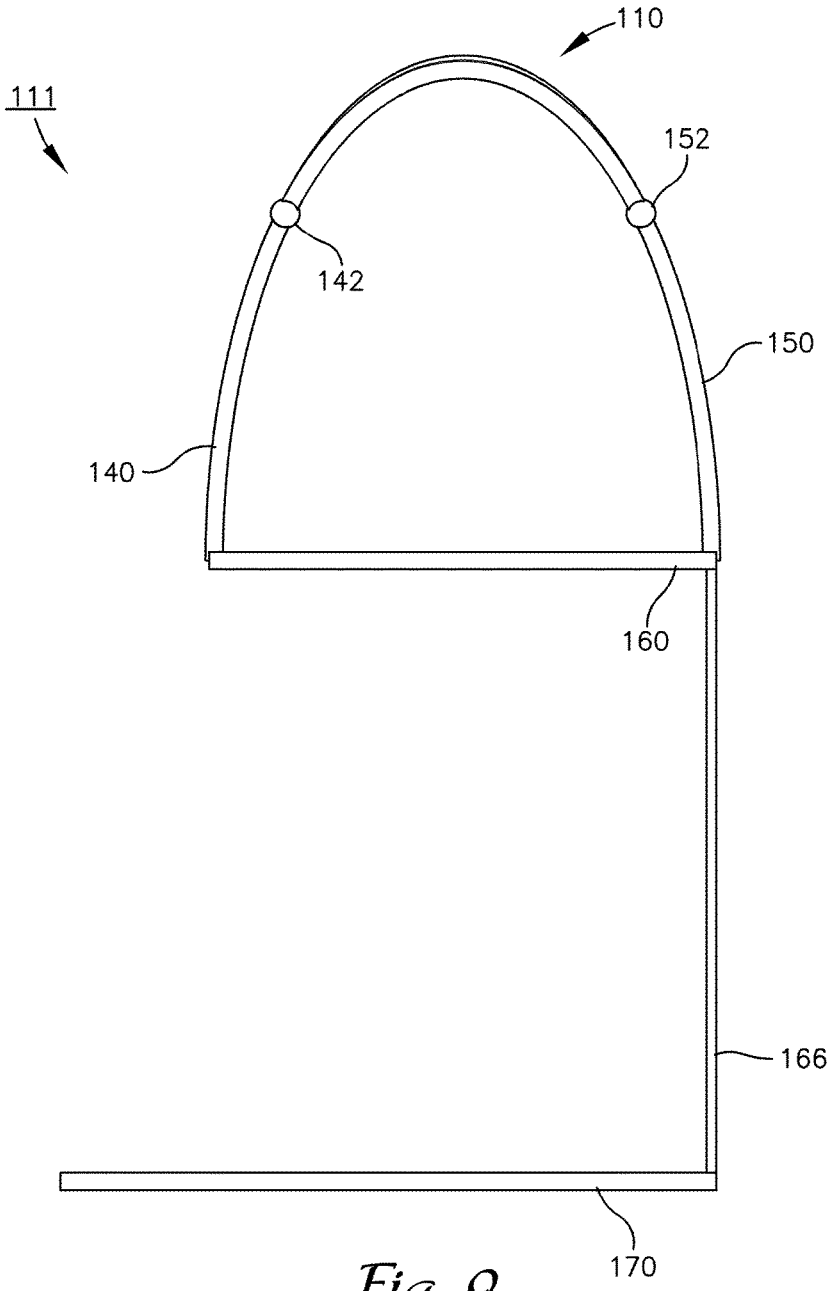
FIG. 9 is a left side elevation of the embodiment of FIG. 7, the left and right side being mirror images.

FIGS. 7-9 illustrate the intersection of the anterior plumed articulation 140 with the upper torso restraint band 160, the intersection presenting a keyed-interlocking structure with the upper torso restraint band 160 having a complementary recessed groove adapted for receipt of the anterior plumed articulation 140. FIG. 8 includes an exemplary fastener associated with the lower torso restraint band 170 which is widely known and may be desired.

The vertical supports 166 are also illustrated in FIG. 7 where the oppositely facing, substantially planar surfaces 166*a* sandwich the upper and lower torso restraint bands 160, 170. An interstitial structure 166*b* extends between the oppositely facing, substantially planar surfaces 166*a* and presents a recess adapted for receipt of the upper and lower torso restraint bands 160, 170 at each end of each of the vertical supports 166.

Various support members in the second alternative embodiment may be comprised of or include a number of alternative supporting, padding or sheathing materials as desired for comfort, longevity or performance.

Another embodiment of the exoskeleton brassiere support structure 211 is depicted in FIG. 11, with an alternative hyperbolic multi-support shoulder structure 210 having an interior support member 212, a central support member 214 and an outer support member 216, for example, extending from the anterior vertical support member 240 at the anterior support junction 242 to the lateral torso restraint band 260. In the depicted embodiment of FIG. 11, the posterior plumed articulation 250 includes an interior articulation, a central articulation and an outer articulation each of them extending continuously from the hyperbolic multi-support shoulder structure 210 at the corresponding interior support member 212, central support member 214 and the outer support member 216 to the lateral torso restraint band 260. In this way, the posterior plumed articulation 250 may join the plural straps associated with the hyperbolic multi-support shoulder structure 210 into a singular structure or as depicted in FIG. 11, may extend them down to the lateral torso restraint band 260 for connection thereat. In this way, the supported load may be dispersed along the lateral torso restraint band 260 (and the wearer's torso), reducing the strain and stress exerted upon the spine at any given point.

Each of the interior, central and outer support members 212, 214, 216 may optionally include an adjustable tensioner 236, allowing for individual adjustment of each of the interior, central and outer support members 212, 214, 216 for adjusting the tension as desired. In this way, the improved exoskeleton chest support structure 211 allows for independent biasing the support structure 211 for selectively biasing the wearer's shoulder such as providing improved posture during operation. This may facilitate further improvement of the strain and stress exerted upon the spine.

By way of example and not as a limitation, during operation of the support structure 211, the interior, central and outer support members 212, 214, 216 may each be horizontally spaced apart for dispersing the supported load in spaced relation to the lateral torso restraint band 60. Using the tensioners 236, the tension of each of the interior, central and outer support members 212, 214, 216 may be independently adjusted to align the wearer's shoulders into a proper posture position thereby allowing for a reduction in stress or strain upon the spine.

In the embodiment depicted in FIG. 11, the interior, central and outer support members 212, 214, 216 generally present a flexible hyperbolic shoulder support which extends from the anterior vertical support junction 242 down to the lateral torso restraint band 260.

Another alternative embodiment of the improved exoskeleton chest support structure 311 is depicted in FIG. 12 with an upper and lower torso restraint band 360, 370 vertically spaced and an alternative hyperbolic multi-support shoulder structure 310 having an interior support member 312. In the depicted embodiment, the posterior plumed articulation is depicted as having three structures corresponding to the hyperbolic multi-support shoulder structure 310. Specifically, the posterior plumed articulation includes an interior articulation, a central articulation and an outer articulation each of them extending continuously from the corresponding interior support member 312, central support member 314 and the outer support member 316 providing an extension from the hyperbolic multi-support shoulder structure 310 to the lower torso restraint band 370 through the upper torso restraint band 360.

In this way, the posterior plumed articulation joins with the hyperbolic multi-support shoulder structure 310, in presenting a substantially continuous structure which extends from the anterior support junction 342 down to the lower torso restraint band 370 for connection thereat. In this way, the supported load may be dispersed along both the upper torso restraint band 360 and the lower torso restraint band 370 corresponding to the wearer's torso and hips, thereby increasing the load carrying capacity of the wearer and reducing the strain and stress exerted upon the spine at any given point.

During operation, each of the support members 312, 314, 316 may also be independently adjusted using one or more separate tensioners (not shown) depending on the desired bias. For example, during operation the central support member 314 may be shortened, while the interior and outer support members 312, 316 may be lengthened. In this way, the user may selectively provide the desired bias upon each of the support members 312, 314, 316 to disperse the supported load. In addition to independently adjusting the tensions for each of the support members 312, 314, 316 a horizontal tensioner (not shown) may be utilized to provide for horizontal spacing of the support members 312, 314, 316.

Many of the support components described herein are substantially rigid and may be fabricated from a rigid wire and may be braided or unbraided steel, aluminum or titanium. One such embodiment includes a support structure like titanium wire being 6 mm in diameter, although other variations may be considered within the scope of the present invention. As desired, a soft, cloth-type protective sheath (not shown) or padding may be utilized to provide a soft, slightly resilient cover in contact with the wearer's skin, the rigid support structure being centrally located therewithin. In addition, it should be understood that the dimensional relationship between the various structures may vary according to the anatomical features of the particular wearers without departing substantially from the dimensional outlines of the preferred embodiment described herein.

While preferred embodiments of the present invention have been described, other embodiments may be designed and modifications may be made thereto without departing from the spirit of the present invention and the scope of the appended claims.

What is claimed and desired to be secured by Letters Patent:

1. A modulating chest support structure for dispersing and supporting a shifting load of a wearer's breast, said support structure comprising:

a lateral torso restraint band having a pair of ends each presenting a breast interface pair each of which is spaced by a pivotal support member;

a hyperbolic multi-support shoulder structure associated with each of said breast interface pair and comprising at least one interior support member, one central support member and one outer support member, each of the interior and outer support members being spaced from said central support member along a lateral axis; and an anterior plumed articulation spaced from a posterior plumed articulation by one of said hyperbolic multi-support shoulder structures, each of said breast interface being secured to said anterior plumed articulation and said lateral torso restraint band secured to said posterior plumed articulation.

2. The modulating chest support structure of claim 1 wherein each of said breast interface further comprises a curvilinear support member, a spherical support member and a bisectional support member extending therebetween.

3. The modulating chest support structure of claim 1 wherein said plumed articulation further comprising an interior articulation, a central articulation and an outer articulation each of which extends continuously from said hyperbolic multi-support shoulder structure.

4. The modulating chest support structure of claim 2 further comprising an anchor support which extends between said lateral torso restraint band and said curvilinear support member.

5. A modulating chest support structure for dispersing and supporting a shifting load over a larger portion of a wearer's torso, said support structure comprising:

an upper torso restraint band vertically spaced from and in communication with a lower torso restraint band by a vertical support;

a hyperbolic multi-support shoulder structure comprising at least one interior support member, one central support member and one outer support member, each of the interior and outer support members being spaced from said central support member along a lateral axis; and an anterior plumed articulation spaced from a posterior plumed articulation by one of said hyperbolic multi-support shoulder structures wherein said posterior plumed articulation and said anterior plumed articulation are secured to opposite sides of said upper lateral torso restraint band.

6. The modulating chest support structure of claim 5 wherein said posterior plumed articulation further comprises an interior articulation, a central articulation and an outer articulation each extending continuously from said corresponding interior support member, central support member and said outer support member through said upper lateral so restraint band to said lower lateral torso restraint band.

7. The modulating chest support structure of claim 5 wherein each of said interior support member, central support member and said outer support member includes a tensioner for selective adjustment.

* * * * *